US007610921B2

(12) United States Patent
Gold

(10) Patent No.: US 7,610,921 B2
(45) Date of Patent: Nov. 3, 2009

(54) METHOD AND ASSEMBLY FOR INCREASING HAIR VOLUME

(75) Inventor: David Anthony Gold, Nepi (IT)

(73) Assignee: Indorata - Servicos e Gestao LDA, Funchal (PT)

( * ) Notice: Subject to any disclaimer, the term of this patent is extended or adjusted under 35 U.S.C. 154(b) by 491 days.

(21) Appl. No.: 10/527,920

(22) PCT Filed: Sep. 15, 2003

(86) PCT No.: PCT/IB03/04181

§ 371 (c)(1),
(2), (4) Date: Mar. 16, 2005

(87) PCT Pub. No.: WO2004/023910

PCT Pub. Date: Mar. 25, 2004

(65) Prior Publication Data

US 2005/0268932 A1 Dec. 8, 2005

(30) Foreign Application Priority Data

| | | |
|---|---|---|
| Sep. 16, 2002 | (IT) | RM2002A0459 |
| Sep. 16, 2002 | (IT) | RM2002A0460 |
| Sep. 26, 2002 | (IT) | RM2002A0479 |
| Oct. 4, 2002 | (IT) | RM2002A0502 |
| Feb. 11, 2003 | (IT) | RM2003A0057 |
| Apr. 3, 2003 | (IT) | RM2003A0152 |
| May 14, 2003 | (IT) | RM2003A0238 |

(51) Int. Cl.
*A41G 3/00* (2006.01)

(52) U.S. Cl. ..... 132/53; 132/201

(58) Field of Classification Search ..... 132/201, 132/53–56

See application file for complete search history.

(56) References Cited

U.S. PATENT DOCUMENTS 4,934,387 A 6/1990 Megna (Continued)

FOREIGN PATENT DOCUMENTS

DE 19626107 9/1997

(Continued)

OTHER PUBLICATIONS

David Anthony Gold, "Method of Lengthening and Thickening Human Hair", ZA Patent Application No. 935214, Filed Jul. 19, 1993, 17 pgs.

*Primary Examiner*—Robyn Doan
*Assistant Examiner*—Rachel R Steitz
(74) *Attorney, Agent, or Firm*—Leffert Jay & Polglaze, P.A.

(57) ABSTRACT

Method for increasing hair volume by thickening and/or lengthening and related assembly, allowing the rapid application, even in batches, of hair extensions with connections almost invisible and perfectly incorporated, of very small dimensions and with no manual intervention required, comprising the steps of: providing one or a plurality of hair extensions having respective proximal ends provided with a respective connecting element; providing a first adhesive tape and adhering it to the hair to be thickened on an area designed to receive said proximal ends; providing a second adhesive tape, having an adhesive face, and adhering on said adhesive face the proximal ends of said hair extensions; adhering said adhesive face to hair to be thickened at said first adhesive tape; and activating connection means operating on said connecting elements of the hair extensions.

24 Claims, 14 Drawing Sheets

U.S. PATENT DOCUMENTS

| | | | | |
|---|---|---|---|---|
| 4,982,748 | A | 1/1991 | Trimarchi | |
| 5,107,867 | A | 4/1992 | Barrington | |
| D336,563 | S * | 6/1993 | Lamb | D3/248 |
| 6,534,172 | B1 * | 3/2003 | Kawashima | 428/343 |
| 6,703,097 | B2 * | 3/2004 | Devine et al. | 428/41.8 |
| 6,756,519 | B2 * | 6/2004 | Johnson et al. | 602/58 |
| 6,935,348 | B2 | 8/2005 | Gold | |

FOREIGN PATENT DOCUMENTS

| | | | |
|---|---|---|---|
| DE | 202 03 301 | * | 1/2002 |
| DE | 20203301 | | 6/2002 |
| JP | 03152205 | | 6/1991 |
| WO | WO 02/098250 | | 12/2002 |
| WO | WO 03/006416 | | 1/2003 |

* cited by examiner

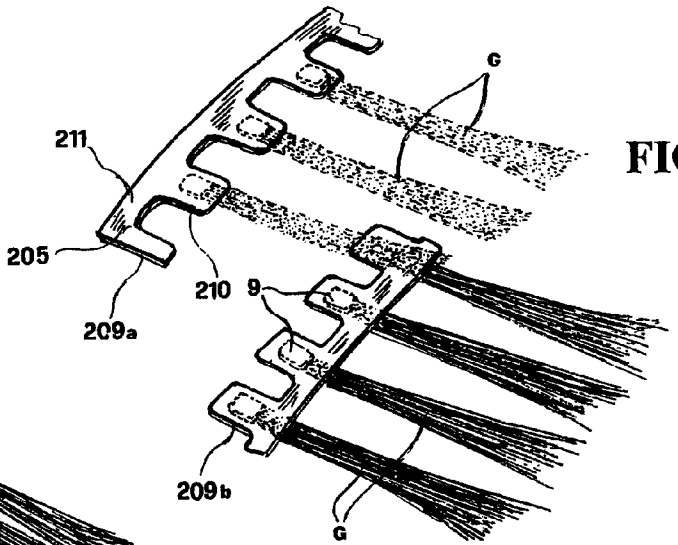
FIG.36
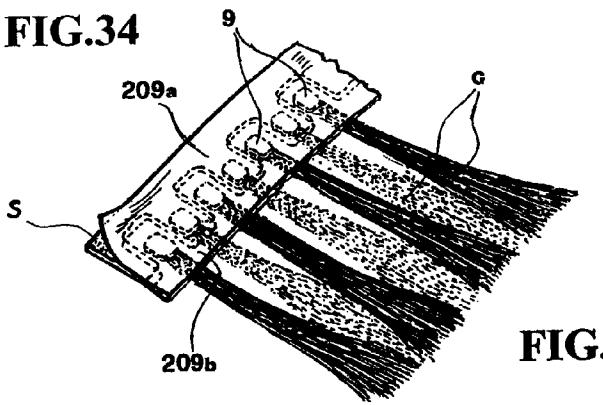
FIG.34
FIG.37
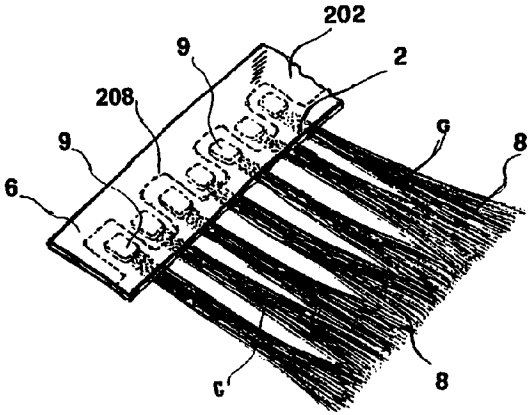
FIG.33
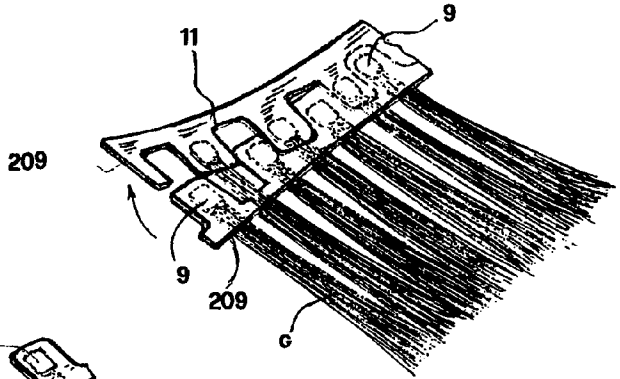
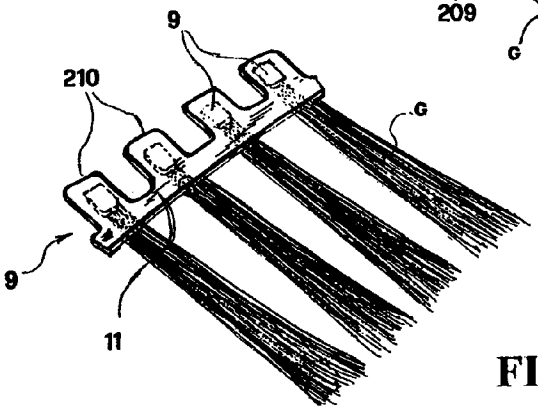
FIG.35

METHOD AND ASSEMBLY FOR INCREASING HAIR VOLUME

STATE OF THE ART OF THE INVENTION

1. Scope of the Invention

The present invention relates to a method for increasing hair volume, i.e., for thickening and/or lengthening hair, and to a related thickening and/or lengthening assembly for increasing hair volume, with hair extensions suitable for use in said method.

2. Description of the State of the Art

Various systems are already known for thickening hair volume and also for lengthening hair. These systems in general use hair extensions or locks, having a natural or artificial origin, which are then fixed to the hair using methods that, based on the proposed application methods, determine the acceptance and satisfaction on the part of the user who has requested such treatment.

Another aspect that helps to increase the satisfaction with this kind of treatment is the speed of implementation.

The known systems include a step wherein the hair extensions are connected to the receiving hair of the user. During this step, the hair extensions can basically be sewn, bonded or knotted to the user's hair but, following these systems, the thickening or the lengthening requires a period of time too long to be carried out, considering that each single hair extension requires a manual and precise operation.

Other methods are known for creating a connection between hair extensions and the receiving hair, requiring the use of external elements such as clasps, combs, grips, etc. These elements can be used to attach hair extensions even of large dimensions to the receiving hair of the user, but they have the great inconvenience that the connection is clearly visible and can be felt by the user, who receives an uneasiness feeling from them.

Amongst other known means, there are those that permit size-reduced extensions to be connected to receiving hair. This methods, that require the use of adhesives, small clasping elements, etc., give fairly good results, but in all cases long application sessions are required since the operator must connect each individual hair extension, which cannot be of larger size as otherwise the connection would be visible to the user and to the observers.

Similar difficulties are present with those methods where an adhesive is used, applied to the connection in the method implementation, for example as in the method described in U.S. Pat. No. 4,934,387 (Megna), which is particularly burdensome in terms of time, since the adhesive is dispensed in a liquid and hot state at the end of each hair extension to be fixed. Besides, the operator should manipulate a hot glue with the fingers, with an understandable discomfort.

Also U.S. Pat. No. 5,107,867 (Barrington) describes such a kind of method, in which the adhesive is provided on the application site in a predetermined quantity from a gun-shaped dispenser or other applicator. However, in Barrington, the adhesive is confined within a heat shrinkable tubing, allowing setting without its sticking to the other hair.

U.S. Pat. No. 4,982,748 (Trimarchi) proposes the use of a thermocurable adhesive, which accordingly requires a heating after a cold application.

However, these examples of application with adhesives require the complex manipulation of several elements: supplemental hair, adhesive, tubing, gun, entailing also an increase in time.

In addition, the cured adhesive forms a sort of ball or skirt which is distinctly noticeable at the touch, decreasing the easiness degree of the method, and which can also be observed, thwarting the desired aesthetical improvement deriving from the thickening.

Another example of this method, which has gained a hold for the thickening and/or the lengthening extension to extension, is described in JP 03152205 (Aderans Co. Ltd.) and in other subsequent patents referred to improvements of this technique, e.g. the improvement developed by the inventor of the present invention, disclosed in South African Patent ZA 93/5214 or in German Patent DE 196 26 107 C.

These documents describe a thickening element and the related method of application wherein a hair extension is fixed to the hair with the application of a thermoplastic adhesive. In this context, it is clear that the application is manual and that therefore it may not be uniform from extension to extension.

The forcedly manual implementation of these known methods therefore implies a series of drawbacks. First, the operator must have a great experience and practice in this technique, to be able of implementing properly made connections, a condition that obviously is not always possible. In addition, apart from experience, it will be extremely difficult to produce uniform connections: they will vary greatly as they will not be positioned exactly along the lines proposed for the hair thickening, and they will vary in quality and size.

All this means that the quality of the finished work will not be optimal, will be more exposed to wear, with imperfections that cannot be rectified, increased costs due to very long application times and the difficulty in locating experienced operators.

In addition, again the cured adhesive forms a sort of ball or skirt which is distinctly noticeable at the touch, decreasing the easiness degree of the method, and which can also be observed, thwarting the desired aesthetical improvement deriving from the thickening.

A further improvement was described in International application WO 02/098250 in the name of the present Applicant and designating the same inventor of the present invention.

In this document, a method and an assembly of hair extensions is disclosed for increasing hair volume, by means of the application of a set of extensions in one step, exploiting an adhesive tape to arrange the connecting elements in the right position and then activating them simultaneously.

This system, though allowing to greatly speed up the application of hair extensions, does not solve the problem of the imperfect connections resulting of unsatisfactory dimensions and that can also be seen.

SUMMARY OF THE INVENTION

The technical problem underlying the present invention is to provide a method for increasing hair volume, as well as a related assembly, with hair extensions suitable to be used in said method, which allow to obviate to the drawbacks mentioned in connection with the state of the art.

The solution idea consists of providing a method and an assembly for thickening and/or lengthening hair with basically no manual operation required and allowing the application of hair extensions in sets, carrying out a perfect integration between the connecting elements supporting the hair extensions and the user's receiving hair. According to this idea, it is proposed to confine the connecting elements, during their activation, in a most restricted space, not allowing in particular to the connecting element to incorporate a high number of hairs, to expand and thus to become visible. In addition, it is desired that this idea be suitably, but not exclusively, applied to the system of thickening and/or lengthening with application of hair extensions in sets. According to an aspect of the present invention, such a problem is solved by a method as above specified, comprising the steps of:

providing one or a plurality of hair extensions having respective proximal ends provided with a respective connecting element;

providing a first adhesive tape and adhering it to hair to be thickened on an area intended to receive said proximal ends;

providing a second adhesive tape, having an adhesive face, and adhering on said adhesive face the proximal ends of said hair extensions;

adhering said adhesive face to the hair to be thickened at said first adhesive tape; and activating connection means operating on said connecting elements of the hair extensions.

According to the same inventive concept, said technical problem is solved by an assembly as above specified, which comprises:

one or a plurality of hair extensions comprising respective proximal ends provided with a respective connecting element;

a first adhesive tape apt to be reversibly applied on the hair to be thickened; and a second adhesive tape, with an adhesive face apt to receive said connecting elements.

In accordance with the same inventive concept underlying the preceding definition, the technical problem at issue is also solved by a method as above specified, comprising the steps of:

providing one or a plurality of hair extensions comprising respective proximal ends having a respective connecting element;

providing an adhesive tape and arranging, according to a predetermined arrangement, said proximal ends onto the adhesive face of a section of said adhesive tape so that the remainder of the adhesive tape may be folded on said section;

enclosing a portion of hair to be thickened between said section and said remainder of folded adhesive tape, determining an area intended to receive said proximal ends; and activating connection means operating on said connecting elements of the hair extensions.

According to the same inventive aspect expressed by this definition of the method, said technical problem is resolved by an assembly as specified above, which comprises:

one or a plurality of hair extensions having respective proximal ends provided with a respective connecting element; and an adhesive tape having a section with an adhesive face onto which there are arranged said proximal ends according to a predetermined arrangement, said adhesive tape comprising a remainder apt to be folded on said section that in turn is apt to be reversibly applied to a receiving hair.

It will be understood that in the above defined methods and assemblies, the basic concept of confining the connecting element or elements between two faces impenetrable and compressed the one against the other is present, thus preventing the compressed connecting element from expanding.

This peculiarity allows to save a quantity of glue for the connecting element that will be of smaller dimensions, i.e., those strictly necessary to make the connection between the receiving hair and the hair extensions.

Using a plurality of extensions in a set on each adhesive tape in one step, it is allowed the fast application of a high number of extensions in one step, simultaneously carrying out a corresponding number of connections with very small dimensions and therefore almost invisible and not detectable by the user.

The present invention will hereinafter be disclosed according to several embodiments thereof, given by way of non-limiting examples and with reference to the annexed drawings.

In the following disclosure, there will be described embodiments with a plurality of hair extensions to be fixed in one step, however a man skilled in this technical field could effortlessly adapt the teachings in said examples for the application of a single hair extension or of a reduced number of them, according to the same inventive concept.

BRIEF DESCRIPTION OF THE DRAWINGS

FIGS. 33 to 37 show, using perspective views, a modified implementation of the detail of FIG. 28;

DESCRIPTION OF THE PREFERRED EMBODIMENTS

Figure 1:
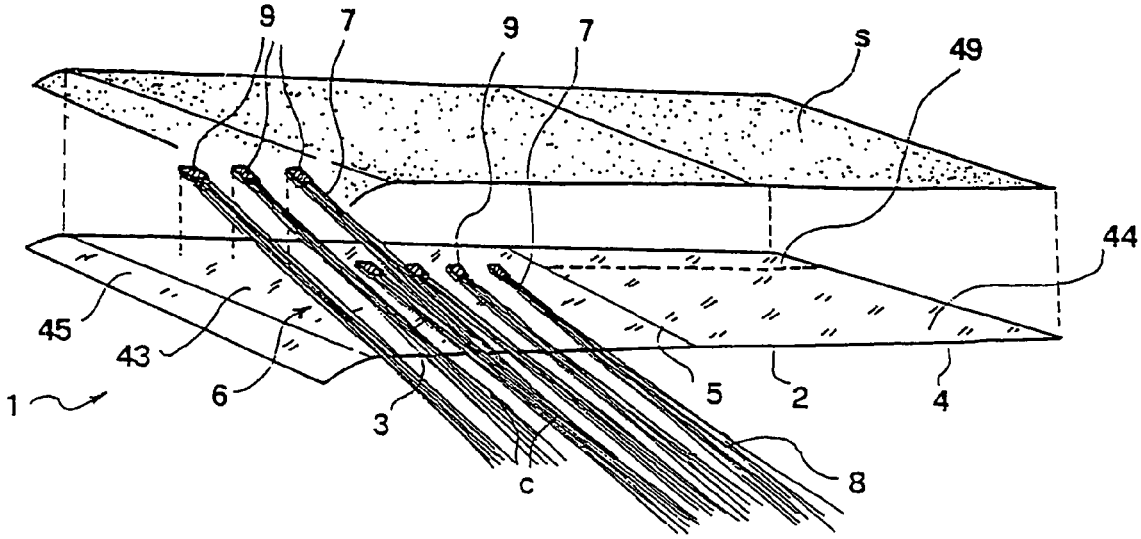
FIG. 1 shows a perspective view illustrating an assembling phase of a first embodiment of an assembly for increasing hair volume according to the invention.
Figure 2:
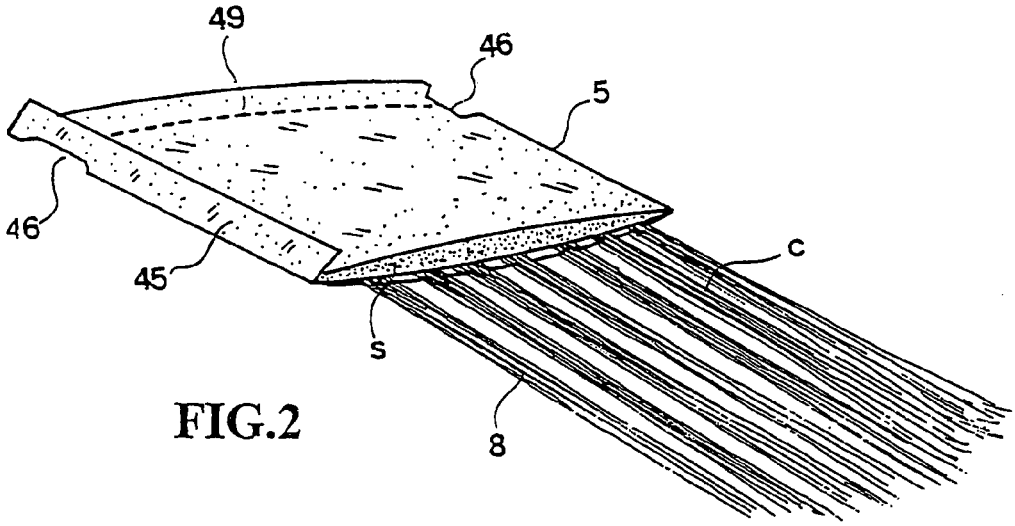
FIGS. 2 and 3 show perspective views of the assembly of FIG. 1, from one side and from another side, respectively.
Figure 3:
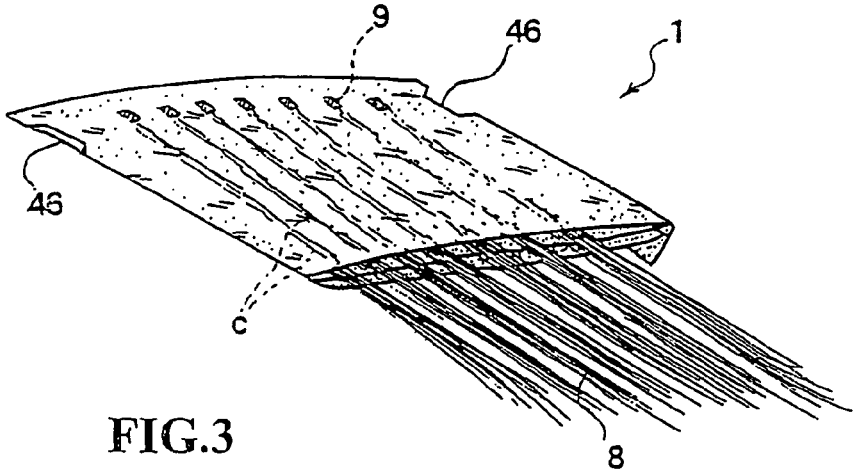

With reference to FIGS. 1 to 3 it is disclosed an assembly for increasing hair volume, generally indicated by 1, which in general comprises hair extensions.

It comprises an adhesive tape 2, which is, preferably but not exclusively, substantially transparent, being intended to be applied to the hair to be thickened and/or lengthened in the method for increasing hair volume according to the invention.

The transparency allows to follow more clearly the application phases and the effect attained even with the tape 2 applied to the hair, as it will be made apparent below.

The material forming the adhesive tape 2 is suitably, but not exclusively, heat resistant for the reason that will be detailed below. The adhesive used on the tape 2 is a non-permanent, pressure operated and reversible type, and it is placed on a single adhesive face of the tape 2.

The adhesive tape 2 has a first section 3, comprising a respective first adhesive face 43, and a remainder 4 of adhesive tape 2 that can be folded on the section 3 completely covering it (FIGS. 2 and 3). Advantageously, in the present embodiment, also said remainder 4 has a respective second adhesive face 44, joined to the aforesaid face.

The section 3 and the remainder 4 are separated by a simple creasing or fold line 5.

Always with reference to FIG. 1, it is disclosed a plurality 6 of hair extensions C, briefly mentioned as extensions, comprising a quantity of substantially predefined hairs which can be natural or artificial, with appropriately selected colors, uniform or streaked. These extensions are basically additional extensions of supplemental hairs that can be connected to the hair for thickening and/or lengthening it.

The assembly 1 according to the invention can comprise extensions C of different thickness, length and color. In general, they extend from respective proximal ends 7, intended to be connected to the hair, to free distal ends 8. In each extension C, the respective hairs have a length that is preferably uniform.

At said proximal ends 7, each hair extension C comprises a connecting element 9 produced, according to the present embodiment, from a thermoplastic material such as polyamide, polyester or even a polyurethane, for example, nylon. Further modifications will be described below.

Each proximal end 7 and each connecting element 9 is placed on said first adhesive face 43 of the section 3 of adhesive tape 2. The connecting elements 9 are substantially equidistant and placed at the center of the tape 4. The extensions C are aligned in parallel to each other, so that the hairs of adjacent extensions C do not get knotted to each other.

The remainder 4 of adhesive tape 2 has means for indicating the position of the connecting elements, which, in the present embodiment, comprises a printed line 49. By folding the remainder 4 onto the section 3, said line 49 is positioned onto the connecting elements 9.

At the opposite with respect to the remainder 4, the adhesive tape 2 comprises a flap 45, the latter being also adhesive, apt to be connected to the remainder 4 folded onto the section 3, substantially in a billfold configuration.

In a folded configuration, the assembly 1 further comprises a pair of recesses 46 obtained onto the tape 2 at the side edges, or onto the creasings connecting the remainder 4 and the flap 45 to the section 3.

Said recesses 46 are positioned at said means for indicating the connecting elements 9 and operate as guides for the connection means that will be described below.

With reference to FIG. 1, the assembly 1 comprises also an optional support tape S, made of a material easily detachable from the adhesive tape 2, like, for example, silicone-coated, linenized paper or plastic, arranged to protect the adhesive faces 43, 44 and the connecting elements 9, so as to prevent the adhesive tape 2 from folding, curling and sticking.

The adhesive material used on said adhesive faces 43, 44 has an adhesive force on the tape 2 greater than that produced on the material of the connecting element 9, so that, on the latter, no adhesive material residues remain at the end of the application. In this preparation technique, it is proposed that the tape 2 be provided with the proximal ends 7 of the hair extensions C already adhered to the adhesive face 43 of the respective section 3, but it is also possible a solution in which the extensions are provided separately with a variety of thicknesses, lengths, colors, etc.

To connect the connecting element 9 to the respective end 7 various, systems can be used, among which hot gluing, injection, etc.

The preferred form of the connecting element is that of a small rectangle, with width and thickness (magnified in the drawings) substantially equal to those of the respective extension 6, to limit to the minimum the quantity of thermoplastic material that, as described below, operates as the adhesive.

In all cases, the size of the connecting element 9 can be the most reduced possible according to the number of supplemental hairs.

Therefore, it is proposed that said connecting element 9 could have different sizes, usually discernible among large, for thick extensions of elevated length and thickness; medium, for extensions of intermediate length and thickness; and small, for extensions characterized by their minimal thickness, suitable for applications thick with extensions.

Again with reference to the present embodiment, the thermoplastic material is a substance suitable for being melted at a temperature higher than the room temperature, assuming the properties of a plastic fluid, and then cooling and solidifying at room temperature.

Substances with similar properties can be melted using the direct application of mechanical energy, in the form of high frequency vibrations, in particular, ultrasonic vibrations (20 to 60 kHz). In this case, the intermolecular vibrations and the resulting friction generate the quantity of heat necessary to plastically move the molecules with respect to each other. The generation of heat stops when the vibrations cease, resulting in an almost immediate solidification.

Examples of substances that can be used as a thermoplastic material are polyesters, polyamides, polyurethanes, etc.

The function of the connecting element according to the present invention is that of holding together the hairs of each extension 6 and that of providing the attachment point of the extension C to the receiving hair of the hair being increased in volume. Other examples of connecting elements are thermoplastic elements, in the form of disk or ball, to which the hair of the extension are fixed. These connecting elements are associated with connection means, for example, made of portions of a thermoplastic substance as already described, or glues and/or adhesives of another nature: pressure hardening, thermocurable, heat shrinkable, etc. Some examples of connecting elements are described in the form of the International application Publ. Nr. WO 02/098250, to the present Applicant and designating the same Inventor of the present invention.

The connecting element 9, which can have a color compatible with that of the hair of the extensions 6, can also be embellished with additional decorative elements such as artificial gems, etc.

All the connecting elements and their variations described above are suitable for the method for increasing hair volume described below.

Figure 4:
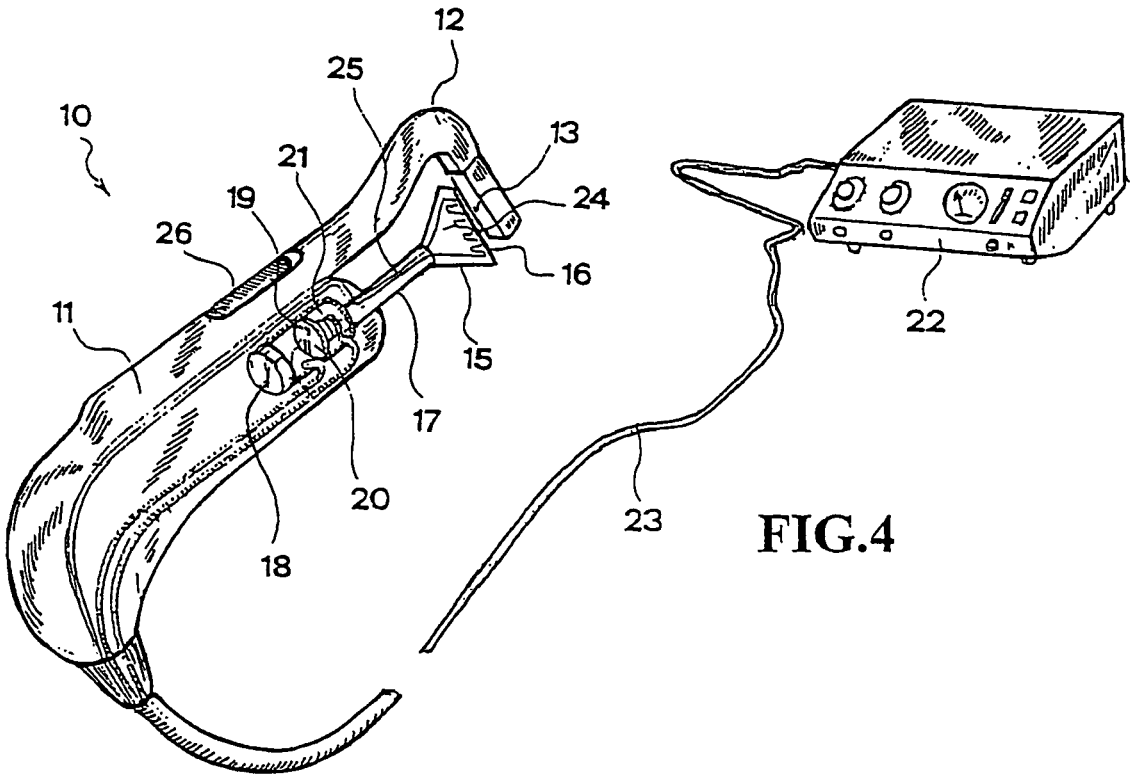
FIGS. 4 and 5 show perspective and partially sectional views of a gripper applicator for the application of hair in extension, suitable in particular for the method for increasing hair volume according to the present invention, and of a respective support base.

With reference instead to FIG. 4, there is described a hair extension applicator, generally indicated by 10, apt to be employed in the present method of application of extensions and of thickening.

In general, it is structured like a gripper and comprises:

- a fixed contrasting element on which there are formed blocking means for a tape; and
- a movable pressure element acting on said fixed element, the movable pressure element being driven by a pneumatic device operating at a predetermined pressure in order to avoid an excessive or a too soft compressing of the connecting element.

In particular, this applicator 10 has a body 11, operating as handle and housing internal devices that will be described below. To the body 11, a fixed contrasting element 12 is secured, comprising a bearing plane 13.

It is noted that the bearing plane 13 is substantially perpendicular to the development of the body 11.

The applicator 10 further comprises a movable pressure element 15 acting on said fixed element 12. It has a pressing plane 16 formed on the extremity of a rod 17 extending from the body 11, the axis of the rod 17 being coincident to the axis of development of the body 11. Also the pressing plane 16 is substantially perpendicular to the development of the body 11.

The movable pressure element 15 is driven by a pneumatic device 18 operating at a predetermined pressure, housed in the body 11 and connected to said rod 17. The pneumatic device 18 comprises a simple effect piston 19 containing a plunger 20 connected to the rod 17 and a spring 21 ensuring the return of the rod 17. The piston 19 is fed compressed air by a control unit 22 via a duct 23. The control unit 22 is provided with an adjustment system of said predetermined pressure.

Figure 6:
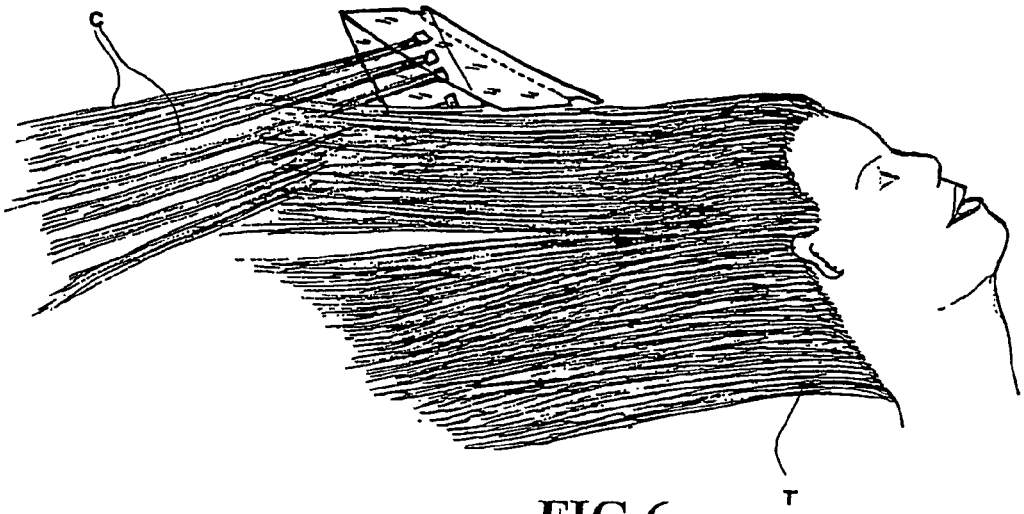
FIGS. 6 to 8 schematically illustrate, using perspective views, various phases of a method according to the present invention, carried out with said first embodiment of the assembly of FIG. 1.

The movable pressure element 15, at its pressing plane 16, is heated to activate the adhesion of the connecting elements 9, advantageously implemented in a thermoplastic material. For this purpose, in the movable pressure element 15 there is housed a thermistor 24 power fed by the control unit 22 via wires 25 at a predetermined voltage from which the temperature depends. Said control unit further comprises a timer that, in response to an actuating button 26 located on the body 11, determines the execution of a compression-heating-decompression cycle implementing the connection between the hair extensions C and the hair T (FIG. 6). Therefore, once the temperature, the pressure and the compression time have been set, the mere actuation of the button 26 determines the execution of the above cycle, i.e., the complete connection of a group of hair extensions C, as it will be made apparent below.

Further examples of applicators suitable for use in the present method are described in WO 02/098250 and WO 03/06416, both to the present Applicant and designating the same Inventor of the present invention.

Figure 5:
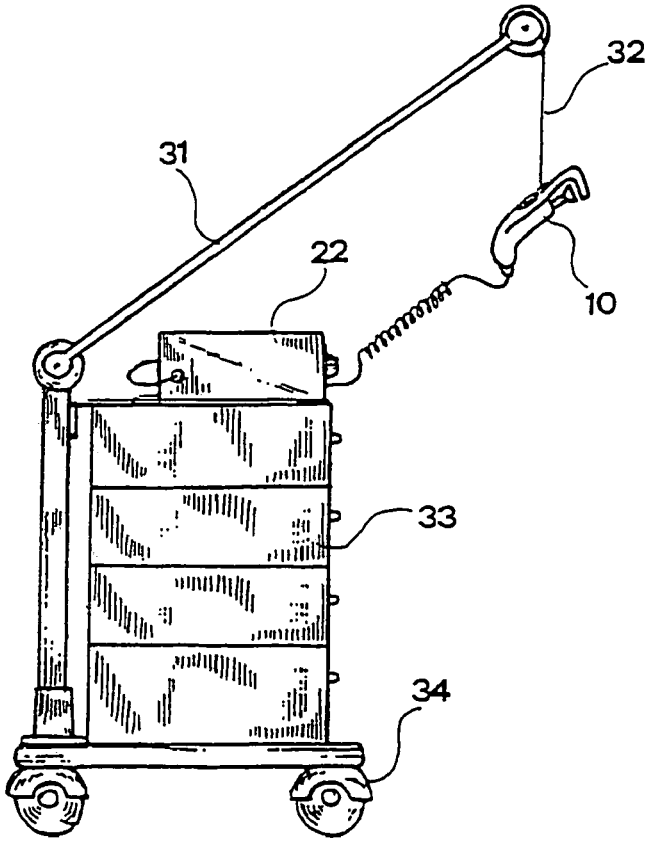

With reference to FIG. 5, the applicator 10 can be mounted in a suitable apparatus, indicated by 30, comprising an extensible and pivotable arm onto which there is suspended a support cable 32 supporting the applicator 10. The cable was connected to a counterweight system that virtually eliminates, for the operator, the weight of the applicator 10.

Figure 7:
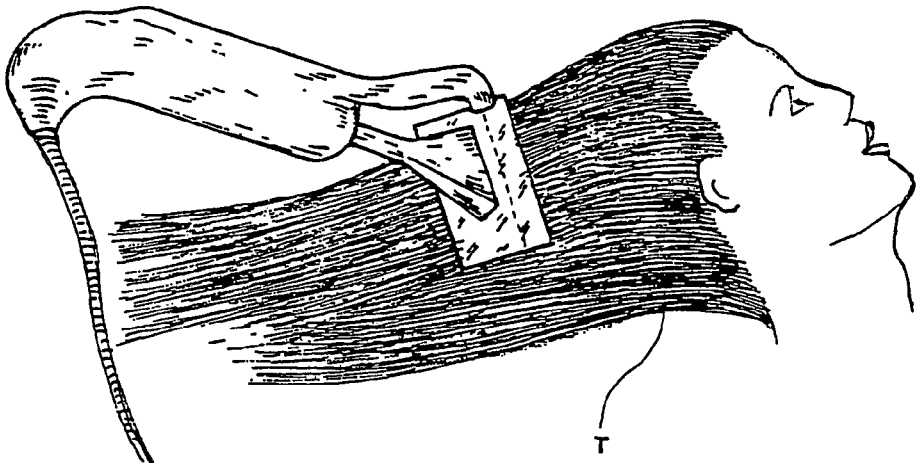
Figure 8:
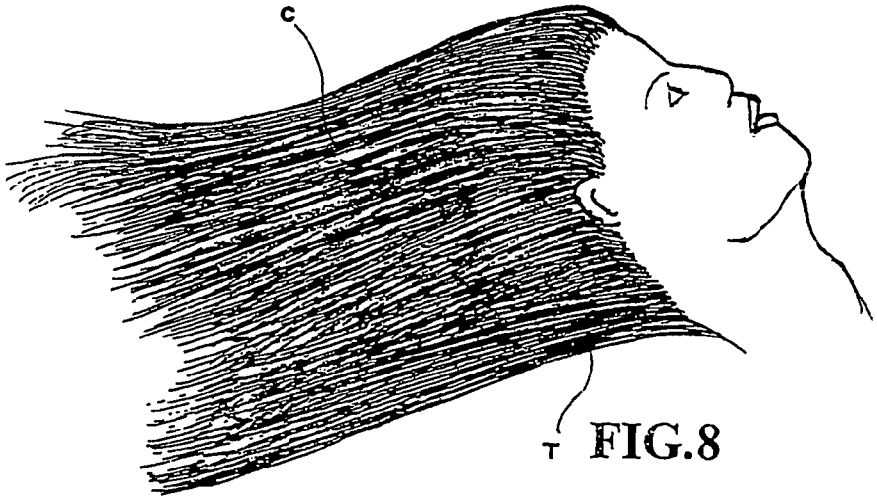

Advantageously, the apparatus 30 comprises a base 33 that supports said control unit 22 and is mounted on wheels 34, so as to position it all facing the user's armchair. With reference to the assembly 1 described above, a method for increasing hair volume comprises the following application steps, described with reference to FIGS. 6 to 8.

According to said method, and in accordance with the above, there is provided a plurality of hair extensions C having the respective proximal ends 7 provided with a respective connecting element 9 adhered, as specified, on the adhesive face 43 of the section 3 of said adhesive tape 2 so that the remainder 4 of the adhesive tape 2 may be folded on said section 3.

The method proposes a step wherein a portion P of the hair T to be thickened is prepared by a combing, to align all hair in parallel to each other.

Subsequently, said method comprises an additional step wherein a portion of hair T to be thickened is enclosed between said section 3 and said remainder 4 of folded adhesive tape 2, determining an area intended to receive said proximal ends 7.

Conveniently, the remainder of tape is externally adhered to the hair, that is with its adhesive face 44 facing the head and the external non-adhesive face.

Therefore, the section 3 is adhered below said hair portion, with the respective adhesive face 43 positioning the connecting elements 9 of the extensions below the hair portion, and therefore hidden.

The adhesion of the section 3 can precede the adhesion of the remainder, and in this phase it is necessary to keep aligned the hairs of the portion P by combing.

Thus, the assembly 1 is closed with a billfold configuration. It should be noted that, in this phase, the top edge of the adhesive tape 2, in correspondence with the connecting elements and not crossed by the extensions C, may be rested on the cutis, thereby uniformly spacing the connecting elements 9 from the cutis itself.

In addition, the portion of adhesive tape 2 crossed by the extensions C winds up the portion of hair T to be thickened, holding it in a fixed position and preserving the direction given by said combing.

By virtue of the adhesion of the flap 45, the perfect overlapping of the section 3 and of the remainder 4 is ensured. The connecting elements 9 remain hidden by the hair portion P, but their position can be determined by virtue of the printed line 49.

Subsequently, the fixed element 12 of the applicator 10 is rested taking the recesses 46 as reference. Then, the movable element 15 can easily be oriented toward the remainder 4 taking said printed line 49 as reference.

In this phase, connection means essentially consisting of said strip 1 and of the connecting elements 9 are activated by the operator.

In the present embodiment, the melting property of thermoplastic material is used. In fact, it is proposed that energy be applied to the connecting elements 9 via the adhesive tape 1. With reference to FIG. 5, the gripper applicator 10 is used wherein the fixed element 12 and the movable element 15 have an elongated shape and can compress, applying a substantially uniform pressure, the entire tape 2 along its length, thereby compressing the connecting element 9.

In this context, an alternative system for transmitting energy to the connecting element 9 can be used as well.

This system proposes the use of mechanical energy in the form of ultrasonic frequency vibrations, for example in the range from 20 to 60 kHz. In this case, one or both of the pressure elements will be connected to a vibrating body, for example a piezo-electric element subjected to alternating current at the desired frequency and they will transmit these vibrations to the connecting element 9, both directly and through the tape 1.

In this case, note that the application of vibrations allows the molecules of the connecting element 9 thermoplastic material to flow easily between the individual hairs of the extension 6 and the hair T, penetrating and joining them together.

Further modifications of the connecting element 9, applicable to all the embodiments of the assembly according to the invention, will be described below.

The first modification implies that the connecting element be made of a particular hot-melt resin called reactive hot-melt glue. This type of glue is known in the art and it has the feature of hardening in the presence of moisture.

In particular, the hardening of this glue could be fostered by air moisture or even by residual moisture in the receiving hair, deriving for example from a shampoo prior to the application of the extensions.

It will be appreciated that the presence of moisture in hair is usually seen as a hindrance to the application of adhesives on hair, but not in this case.

Another modification involves the use of a two-pack adhesive with both components being hot-melt. Said components could be incorporated in the same connecting element or arranged facing opposite adhesive faces of the tape 2. Alternatively, one of the components could be sprayed in the form of powder on the hair prior to the application of the connecting elements 9, in this case realized with the other component. The excess powder would be brushed away after application of the extensions C.

Turning to the present embodiment, the applicator 10 is actuated via the button 26, and a constant pressure, not subordinate to the thickness of what is comprised between the elements 12, 15 operating like a gripper, is exerted for a time interval of predetermined length, uniformly along the remainder 4, or equally on each connecting element 9 that is transformed in a connection on the hair.

It is proposed that this application, according to the same modes, could be repeated an infinite number of times always with identical results and without requiring the operator to exert any muscle force.

Conveniently, it is possible to apply plural adhesive tapes 2, to then activate said connection means in a rapid sequence.

It is proposed that operation parameters like: exerted pressure, pressure duration, heating (temperature), heating duration, vibration frequency, vibration intensity, duration of vibrations, could be preset and stored in the control unit, and could be varied according to the specifications of the extensions and of the connecting elements to be applied.

Once this connection step is complete, it suffices, at the end of the cooling, to remove adhesive tape 2 without leaving any glue on the hairs (FIG. 8), to complete the application.

In order to better highlight the peculiarities of the method, the step of activation of the connection means will be detailed with reference to FIGS. 9 to 13.

Figure 9:
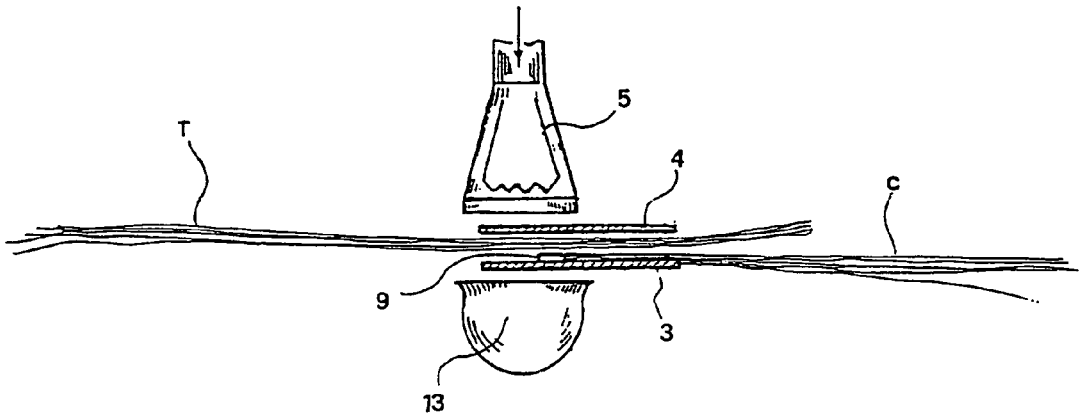
FIGS. 9 to 11 show a cross section of a detail of the applicator of FIG. 4 during of a phase of the method according to the invention with the assembly of FIG. 1.

The fixed element 12 is manipulated so as to be facing below the section 3, whereas the remainder 4 is adhered to the support plane 13 (FIG. 9).

Figure 10:
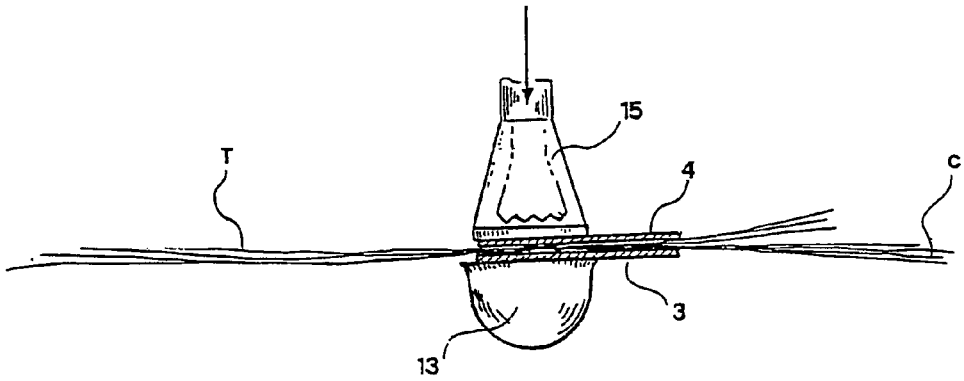

The applicator 10 is actuated for the compression-heating cycle. The combined heat and pressure, crossing the tape 2 void of connecting elements 9, melts the thermoplastic material that penetrates between the hairs of the hair T and of the extension C (FIG. 10).

More specifically, (FIG. 12), placing the movable element 15 at said means for indicating the position of the connecting elements 9, automatically said movable element 15 is placed in a correct position.

The compression and the heating melts the thermoplastic material from the side facing said remainder 4, through the hair T entrapped between the movable 15 and fixed 12 elements.

Thus, the thermoplastic material tends to migrate through the hair T and anyhow its position is confined on both sides by the tape 2 (FIG. 13) with the pressure uniformly conveyed by the operator, through the tape portions and the entrapped mass of hair.

Figure 13:
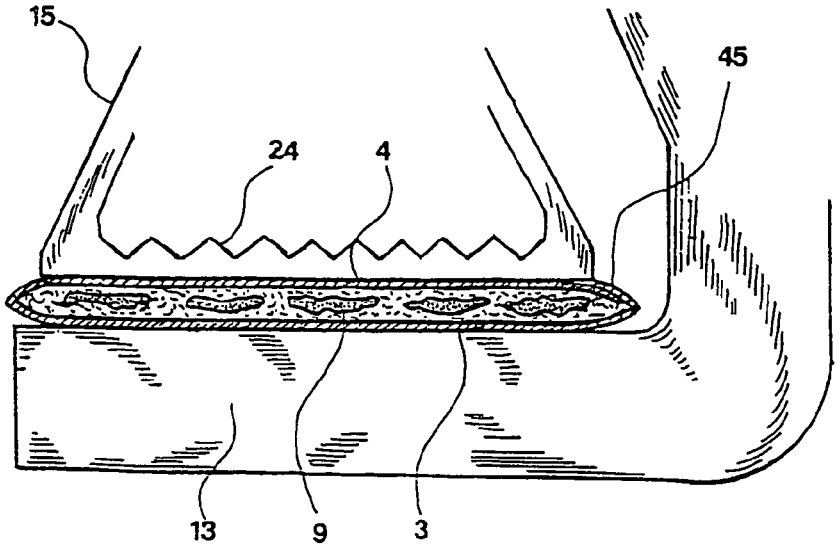
FIGS. 12 and 13 show an enlarged longitudinal section of a detail of the applicator of FIG. 4 during of a phase of the method according to the invention, with the assembly of FIG. 1.
Figure 12:
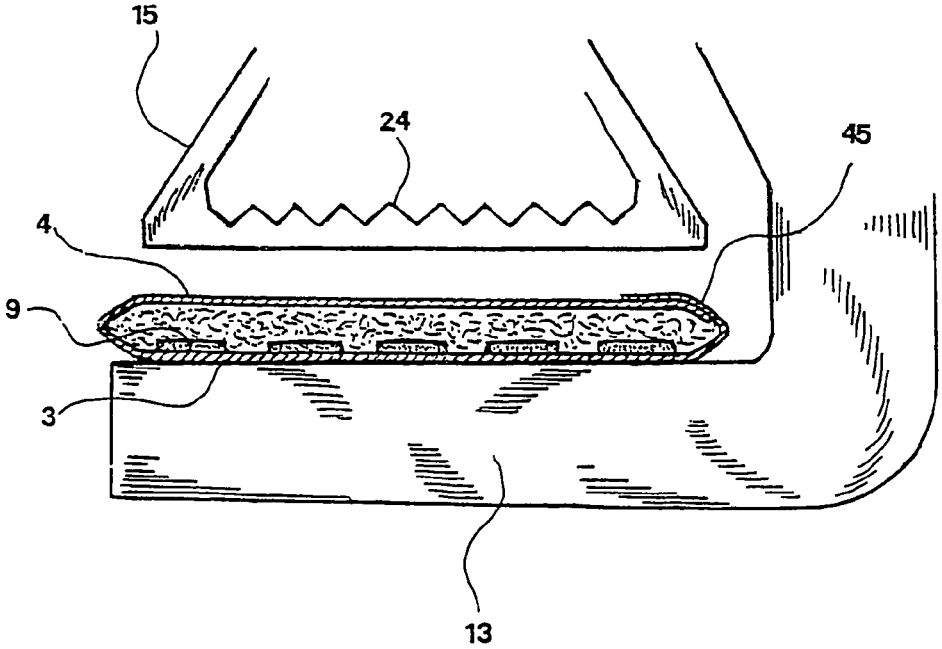
Figure 14:
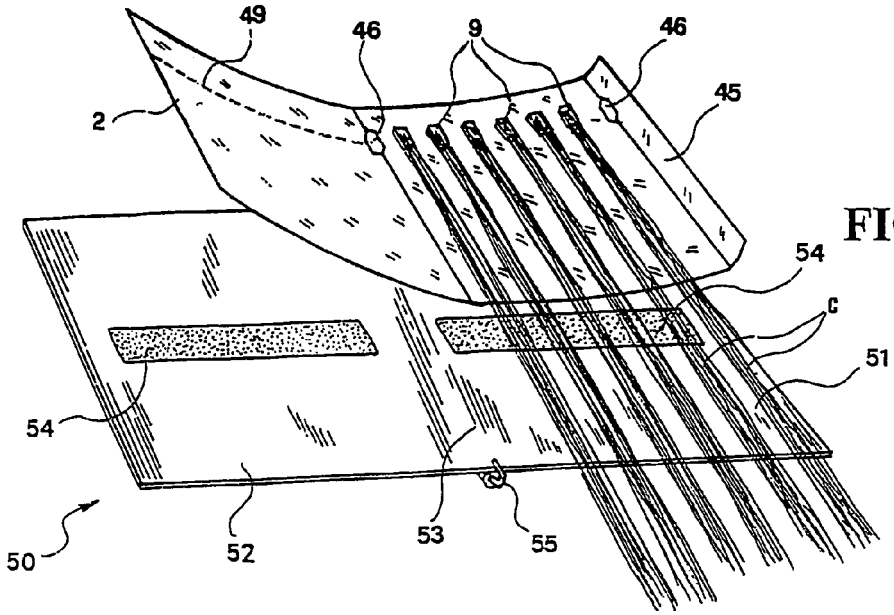
FIG. 14 shows a partially exploded perspective view of an assembly according to said first embodiment with an application device in an application kit.

This process prevents the thermoplastic material from being compressed on the face of one of the tapes, and it is prevented the formation of plane and shiny faces of solidified thermoplastic material, faces that otherwise would be visible (FIG. 13).

Figure 11:
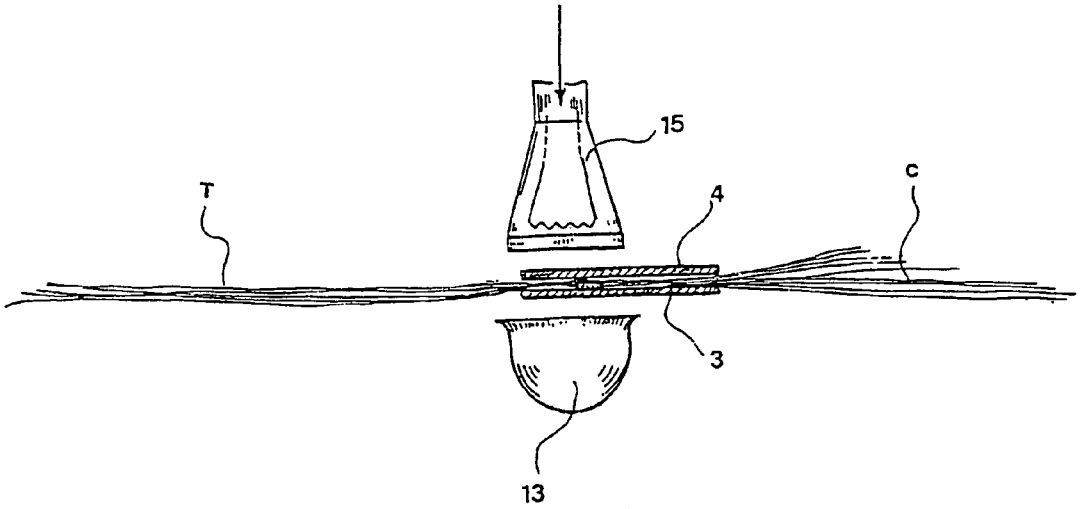

Once the pressure and the heating are discontinued, the thermoplastic material solidifies remaining confined between the tape 2 (FIG. 11). After a reasonable yet very short cooling the tape 2 can be removed, but it is also possible to remove all tapes once the application of plural assembly 1 has taken place.

However, it is proposed that the dimensions of the connecting element and of the thermoplastic material portion may be reduced at will, without substantially influencing the capacity of the extensions C to be connected to the respective hair.

From the description, it is proposed that this method of hair extension does not require any manipulation on the part of the operator and enables the formation of extension-receiving hair connections with very small dimensions, considering that the pressure elements, with the presence of two tapes, contain the material that enables the connection to occur. The resulting connections are very subtle, with finished edges, void of shiny faces, almost imperceptible. The only manual intervention is based on manipulating the device that is used to activate the connection.

The dimensions of the connection are not subordinate to the fact that the thermoplastic material and the hair of the extension must forcibly surround the hair of the hair, creating a connection point whose volume cannot be reduced below a certain limit. For example, in the above cited JP 03152205 (Aderans Co. Ltd.), the simple fact that the hair of the extension must be wound around the hair of the creates in itself a voluminous connection.

According to the present invention, the dimensions of the connection point depend exclusively on the quantity of hair compressed within the extension: the more subtle the extension, the more subtle the connection.

The lack of manipulation therefore leads to the formation of uniform connections. Their optimal quality prevents disconnection due to, for example, penetration of water and the like.

With this system, it is also possible to hide the extensions within the hair. Then, because it is possible to apply extensions equidistant to each other, additional extensions can be applied between them, with the possibility of obtaining consistent extensions within brief periods and to create complex streaks (highlights) by mixing in extensions with colors different to the hair of the user.

With reference to FIGS. 14 to 17 there is described the assembly 1 of the preceding figures, provided with a complementary tool identified as folding element 50 that has a bill-fold configuration, it being provided with a pair of rectangular flaps, in particular a first flap 51 and a second flap 52, united by a folding line 53 or creasing. The folding element is implemented in a rigid or semi flexible material, e.g. an easily molded plastic material, so that the flaps 51, 52 be apt to adhere to the tape section 3 receiving the connecting elements 9 of the hair extensions C and to the remainder 4 closing on the tape section 3. This adhesion provides support and rigidity, allowing to easily manipulate the tape 2 with no risk of the section 3 and the remainder 4 folding, adhering on inappropriate spots or anyhow assuming an incorrect configuration.

In order to ease the adhesion, the folding element comprises means for securing the tape 2 to the flaps 51, 52. Said securing means comprises adhesive strips 54 arranged on the inner face of the flaps 51, 52, where for inner face there are meant the faces adapt to adhere to each other by virtue of the folding of the folding element 50.

Said adhesive strips are arranged so as to extend from the folding line 53 to the outer edge of the folding element 50. Thus, it is possible to secure to the folding element 50 the tape 2 with the folding line 5 of the latter arranged just at the folding line 53 of the folding element 50.

In addition, said securing means comprises retractable hooks 55 located at the ends of the folding line 53. The retractable hooks 55 are movable between an engagement position of the tape 2 to the folding element 50 and a disengagement position, away from the extremity of the folding end 53.

Figure 16:
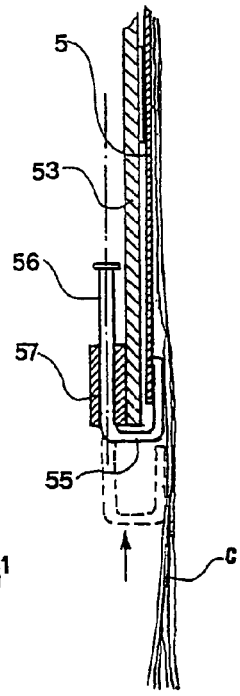
FIG. 16 shows a section of a detail of the kit of the preceding figure.
Figure 15:
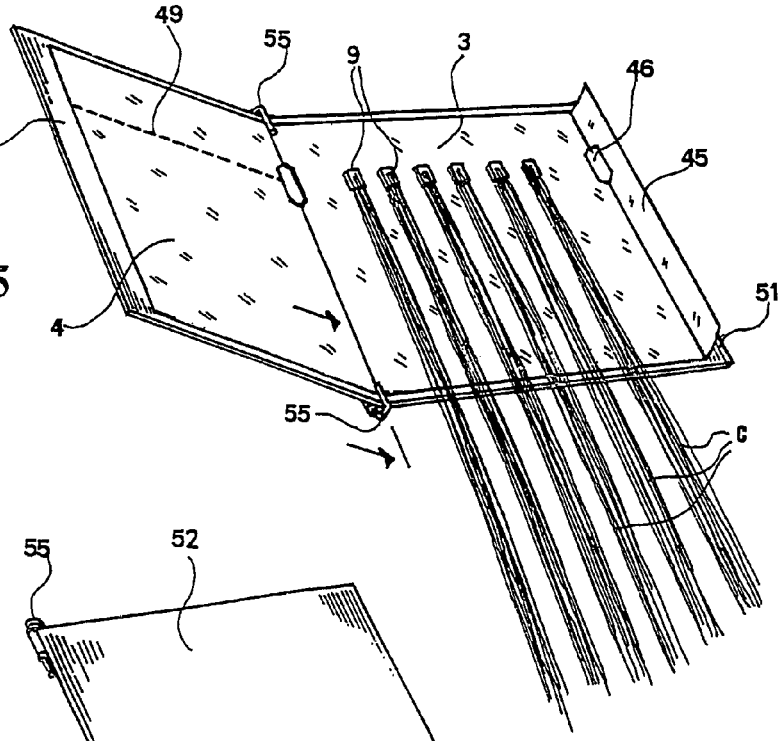
FIG. 15 shows a perspective view of the kit of FIG. 14, completely assembled.

For this purpose, each retractable hook 55 is provided with a stem 56 slidably located into a sleeve 57 associated to the folding line 53 on the outer side of the folding element 50. The free end of the stem 56 can be controlled simply with the tip of a finger, adjusting the position of the retractable hook 55 (FIG. 16).

Figure 17:
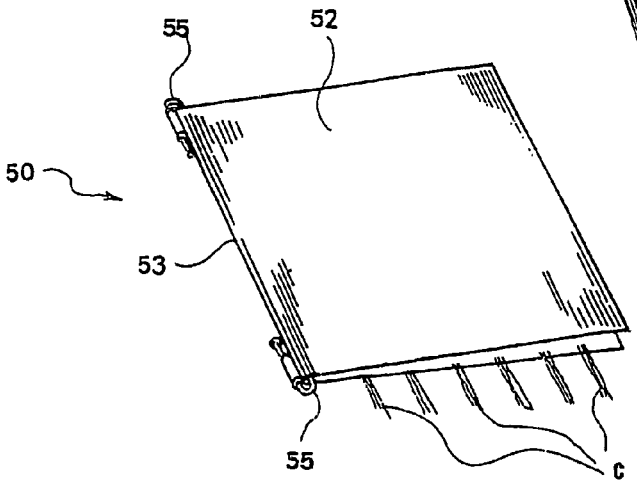
FIG. 17 shows a perspective view of the kit of FIG. 14 in a different configuration.

The function of each hook 55 is to entrap the tape 2 on the folding element, so that the folding lines 5, 53 be overlapped (FIG. 17).

Advantageously, the width of the tape 2 is equal or similar to that of the folding element 50, whereas the latter will have a greater length, so that the portions of the tape 2 be completely encloseable by the folding element 50 (FIG. 17).

Figure 18:
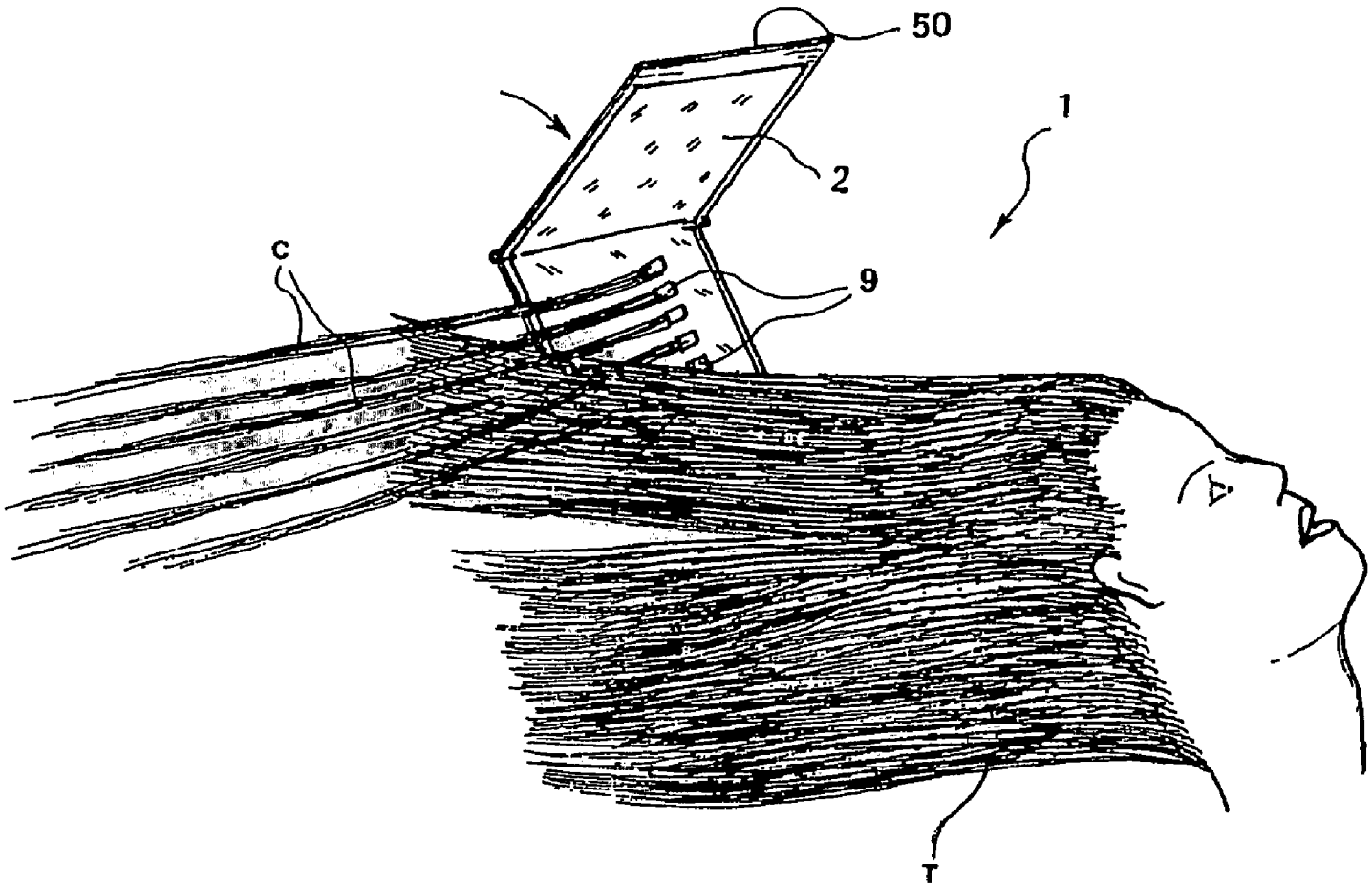
FIG. 18 schematically illustrates, using a perspective view, a phase of application of hair extensions using the kit of FIG. 14.
Figure 19:
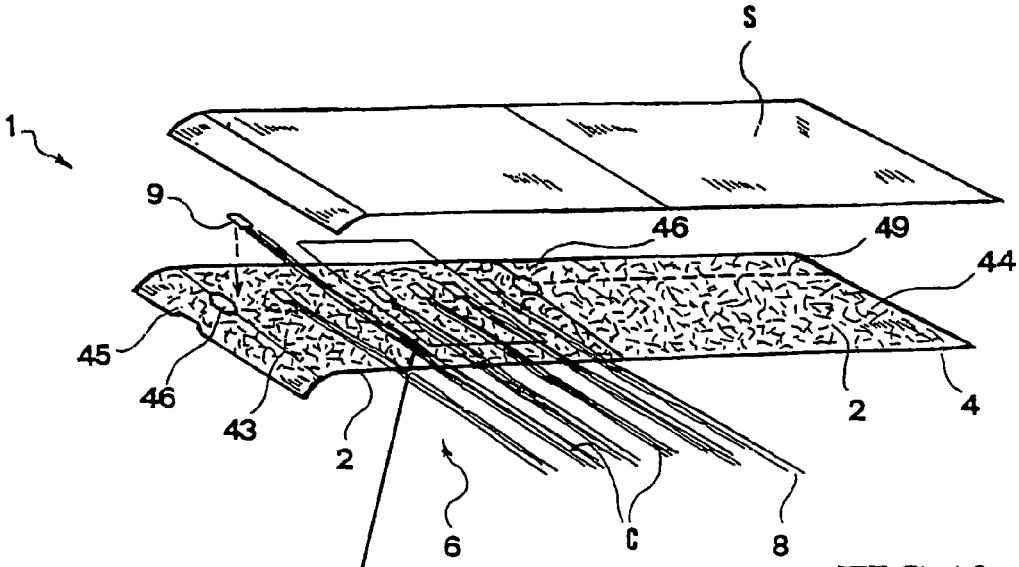
FIG. 19 shows a perspective view illustrating a phase of assembling a second embodiment of an assembly for increasing hair volume according to the invention.
Figure 20:
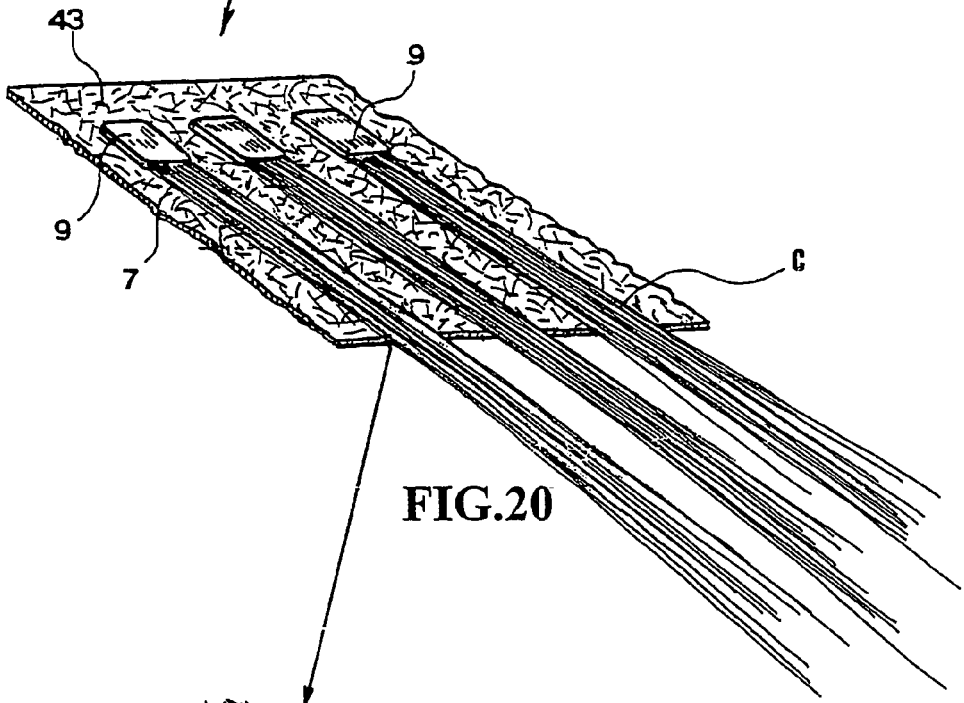
FIGS. 20 and 21 show, using perspective views, a detail of the assembly of FIG. 19 with a gradually increasing enlargement.
Figure 21:
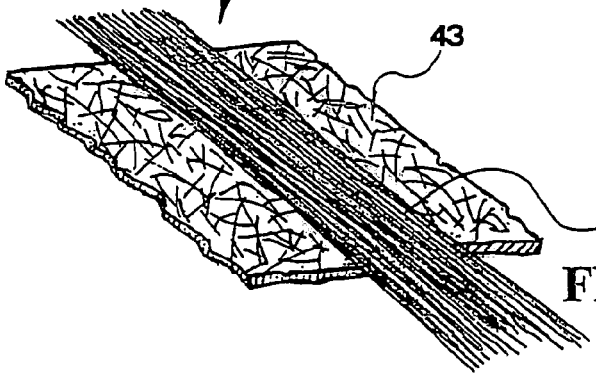
Figure 22:
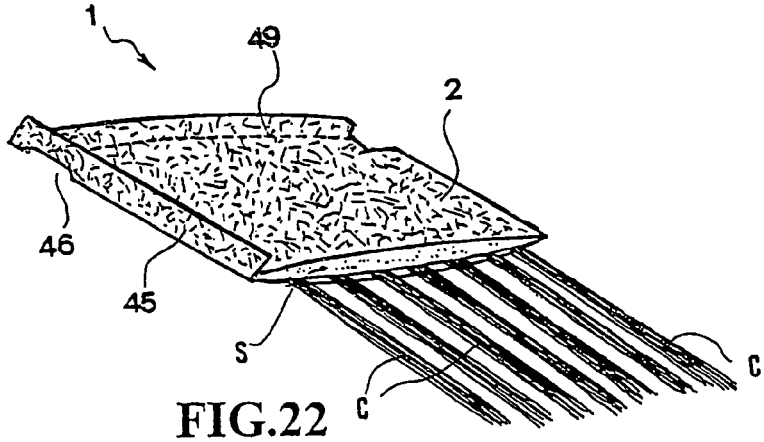
FIGS. 22 and 23 show perspective views of the assembly of FIG. 19, from one side and from another side, respectively.
Figure 23:
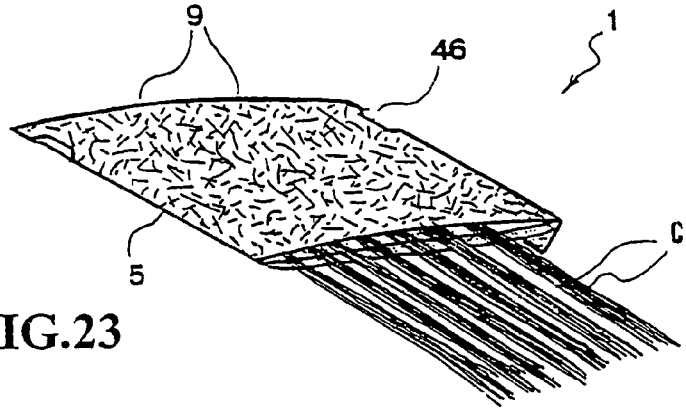

With the folding element (FIG. 18), the method for increasing hair volume comprises a phase in which a portion of the hair to be thickened T is enclosed between said section 3 and said remainder 4 of folded adhesive tape 2, determining an area intended to receive said proximal ends 7.

In this step, the folding element 50 is used to correctly drive the tape 2 on the selected portion of the hair T.

Therefore, it is proposed that the folding element 50 is in this case incorporated in the assembly 1 described above insofar as it is driven by the folding element 50. In different phases, in particular in the diffusion of the assembly, the folding element 50 could be separately managed.

With reference to FIGS. 19 to 26, there is now disclosed a second embodiment of the assembly for increasing hair volume that can be used in the related method without modifications in the application steps. All the portions disclosed with reference to the preceding embodiment are present and are indicated by the same reference numbers.

The section 3 of tape 2 receiving said connecting elements 9 and also the section intended to be folded have faces that are intended, during the application steps that will be described below, to come into contact with said connecting elements 9.

These faces, identifiable in this example with the adhesive faces 43, 44 but optionally confined to the contact areas of the remainder of tape 2 that is folded, are covered by a thin layer of fluff, that is fibers dispersed on the adhesive face.

Various types of fibers can be used. Natural fibers will be preferred, capable of making, with the modes that will be described below, the face of the connecting elements velvety to the touch. Of course, the preferred color will be equal to that of the hairs of the extensions.

This layer of fluff can be made in various holding modes, e.g. of electrostatic type or spray. For the sake of easiness, the entire adhesive face of the tape may be interested, with the same adhesive holding the fluff but maintaining an adhesivity such as to hold in their position also the connecting elements.

In the application of the assembly 1, the two portions 3, 4 of the tape 2 determine the close contact of said fluff layer on both faces of the connecting element 9.

The temporaneous controlled melting of the connecting element 9 and the exertion of a pressure on it imply that the faces of the tape 2 come into contact with the top and bottom faces of the connecting element 9 itself, and in this phase, in which the connecting element 9 lies in a semi melted layer, it receives the layer of fluff that are partially buried on its face, making it soft and velvety to the touch, as well as substantially opaque and of the same color of the hair.

This effect effectively mingles each connecting element with the hair T. Also in the case of artificial or natural light projected directly on it, the connecting elements do not reflect more light than the hair do.

It is proposed that the use of the folded tape allows to make velvety both the faces of the connecting elements even though in other production examples the exposed top faces could be made velvety, using tapes selectively covered with fluff.

The latter may be flocked on the adhesive face of the strip, but can also be mixed to the adhesive or even, subsequently to the holding, covered with a further layer of adhesive to secure it more tightly to the tape.

Taking into account the fact that the satisfaction for the application of hair extensions is subordinate to a substantial invisibility of the artificial origin of the thickening, it is implemented by means of a likeness between added hair and user's hair, but most of all by mingling the connecting elements with the hair.

For this purpose, a modification of the preceding embodiment proposes that the section 3 of tape 2 receiving said connecting elements 9 and also the section intended to be folded have faces that are intended, in the application steps described below, to come into contact with said connecting elements 9.

These faces, identifiable in this example with the adhesive faces 43, 44 but optionally confined to the contact areas, are creased.

In particular, said faces have a surface roughness such as to make the tape 2 opaque rather than shiny. Such a roughness can be obtained by three modes:

- by a mechanical corrosion, implementable for example with a sanding;
- by a chemical corrosion, implementable for example with an acid bath in which the tape is immersed; or
- by an abrasion, implementable with abrasive pads rubbed on the tape face.

In addition, said faces have a second type of creasing, of surface dimensions greater with respect to the preceding one. Said second type of creasing is such that the tape face comprises a plurality of ribs and grooves of transversal dimensions similar to the diameter of an individual hair and of orientation parallel to that of the hairs of the extensions C.

Such ribs and grooves can be newly generated on the tape face by three modes:

by an extrusion implemented with a suitable mold;

by chemical etching, implementable for example with an adapt silk-screen pad and a corrosive agent applied through the pad; and by a mechanical removal of aligned strips of tape material with suitable abrasive means or surface etching means.

It is proposed that both these typologies of creasing can be adopted separately on the face of the tape 2, for giving to the connecting element, during its activation, a opaque face (due to the surface roughness) or a grooved surface (due to the ribs and to the grooves) that mingles with the hair.

In addition, it is proposed that said typologies can be adopted contemporaneously to give to the connecting element both the above effects.

The temporaneous controlled liquefaction of the connecting element 9 and the exertion of a pressure on it implies that the faces of the tape 2 come into contact with the top and bottom faces of the connecting element 9 itself.

The creasing of the faces of the tape 2 is impressed on the opposing faces of the connecting element 9 that thus is opaque, by effect of the surface roughness, and streaked, by effect of the ribs and the grooves, in the sense of the hair.

These effects, advantageously combined among them, determine the effective mingling of each connecting element with the hair T. Also in the case of artificial or natural light directly projected on it, the connecting elements do not reflect more light than the hair do.

These effect can be alternate to or combined with the application of fluff as described above.

With reference to FIGS. 27 to 32, a third embodiment of the assembly for increasing hair volume according to the invention and a related embodiment of method, anyhow analogous to that described above, that is characterized by the same inventive concept, will be described below.

Components analogous to those described above will be indicated by the same reference numbers.

Said assembly, generally indicated by 1, comprises a first adhesive tape 102 provided for example in the form of a roll 103. Preferably, but not exclusively, it is substantially transparent, being intended to be applied on the hair to be thickened in the method for thickening. Therefore, the transparency enables to follow more clearly the application steps and the effect attained even for the applied first tape 102.

The material forming the adhesive tape 102 is preferably, but not exclusively, heat resistant for the reason described above. In this embodiment as well, the adhesive used is a non-permanent, pressure operated and reversible type, and it is placed on a single adhesive face of the first tape 102.

The assembly 1 comprises a second adhesive tape 104, in the present embodiment substantially analogous to the previous one. It is preferably transparent, in a material resistant to heat as the preceding one, and has an adhesive face 105.

Always with reference to FIG. 1, it is described a plurality 6 of hair extensions C, comprising a quantity of substantially predefined hairs which can be natural or artificial, with appropriately selected colors, uniform or streaked.

Also this assembly 1 can comprise extensions C of different thickness, length and color. In general they extend from respective proximal ends 7, intended to be connected to the hair, to free distal ends 8. In each extension C, the respective hairs have a length that is preferably uniform.

At said proximal ends 7, each extension C comprises a connecting element 9 produced, according to the present embodiment, in a thermoplastic material, such as polyamide or polyester or even a polyurethane, for example, nylon. This element is in all analogous to those described above, optional modifications included.

Each proximal end 7 and each connecting element 9 is arranged on said adhesive face 105 of the second adhesive tape 104. The connecting elements 9 are substantially equidistant and placed at the center of the tape 104. The extensions C are aligned in parallel to each other, so that the hair of adjacent extensions C do not get knotted to each other.

Figure 27:
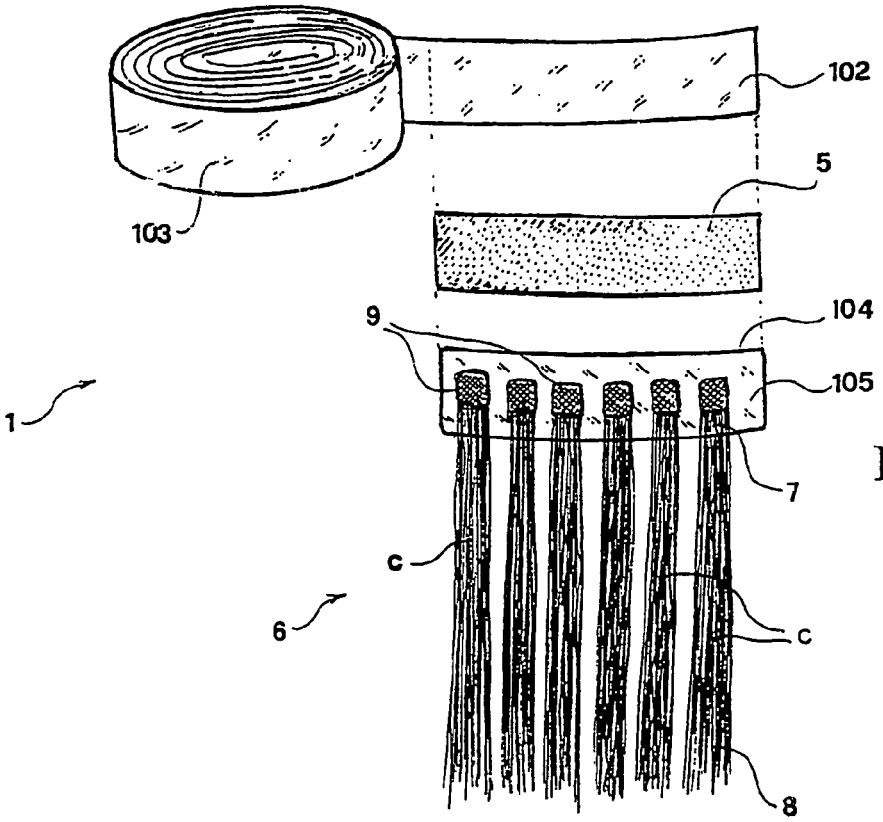
FIG. 27 shows a perspective view illustrating a phase of assembling a third embodiment of an assembly for increasing hair volume according to the invention.
Figure 24:
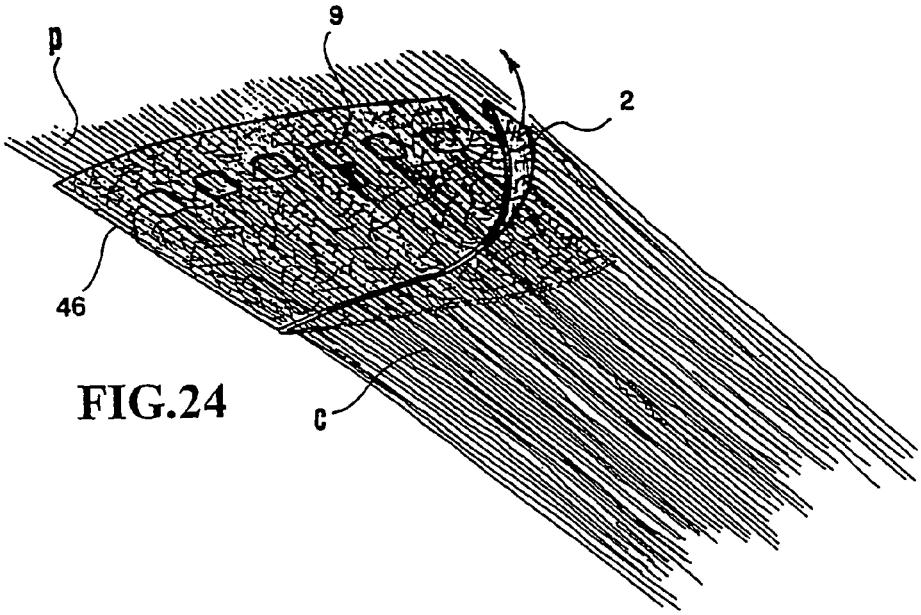
FIGS. 24, 25 and 26 schematically illustrate, using perspective views, with a gradually increasing magnification on a specific detail, phases of application of hair extensions with the assembly of FIG. 19.
Figure 25:
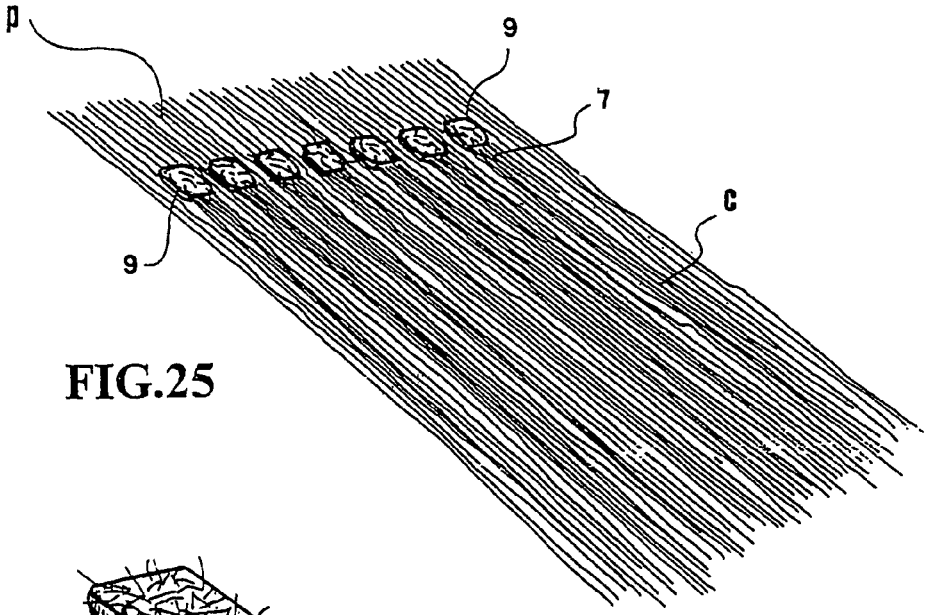
Figure 26:
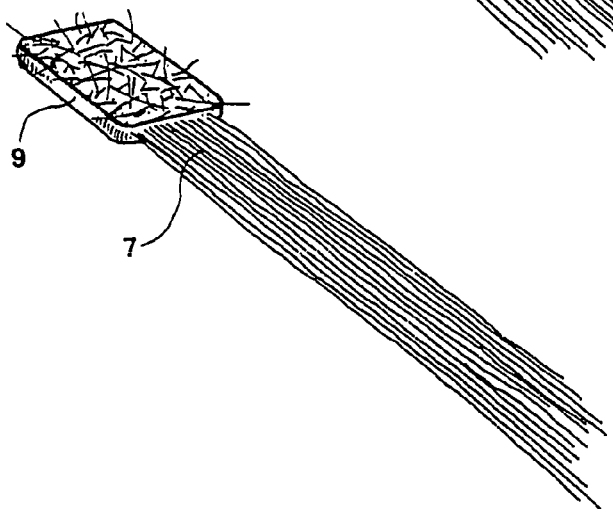

With reference to FIG. 27, the assembly 1 optionally comprises also a support tape S, made of a material easily detachable from the adhesive tape 1, like for example silicone-coated paper or plastic arranged to protect the adhesive face 104 and the connecting elements 9, so as to prevent the second tape from folding, curling and sticking.

The adhesive material used on said adhesive face 105 has an adhesive force on the second tape 104 greater than that produced on the material of the connecting element 9, so that on the latter no adhesive material residues remain at the end of the application.

Optionally, the second adhesive tape 104 could have an undefined length and the operator could cut sections to select the desired number of extensions 6. The same can be said for the first adhesive tape 102, which, as it will be made apparent below, could be cut in sections substantially of equal length of the corresponding sections of second tape 104.

In this preparation technique, it is proposed that the second tape 4 be provided with the proximal ends 7 of the extensions C already adhered to the respective adhesive face 105, but it is also possible a solution in which the extensions are provided separately with a variety of thicknesses, lengths, colors, etc.

In this case, extensions could be selected immediately and placed on the second tape 104 optionally resorting to positioning means, which can comprise: marks or recesses obtained on the tape 104 or a stencil to be arranged to support the transparent tape 104 to place the extensions in a guided manner. There could be provided marks and traces of size compatible to that of the connecting elements 9, in turn sized depending on the thickness and the width of the extension. These marks or traces could also suggest the positioning density, that is the pitch separating adjacent extensions.

Figure 29:
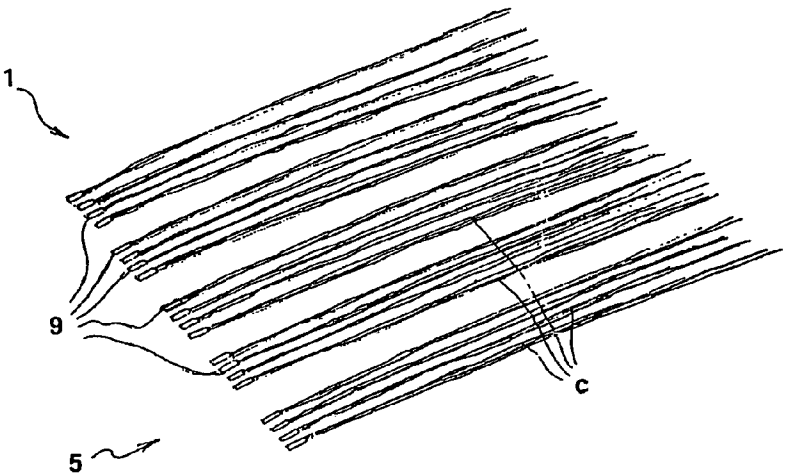
FIG. 29 shows a perspective view of a modification applicable to the assembly of FIG. 27 and also to the assemblies of FIGS. 1 and 19.

These modifications will be detailed below. With reference to FIG. 29, it is proposed an example of arrangement of extensions C' of very small thickness, called mini-extensions, which can be grouped in place of an individual hair extension C.

Figure 30:
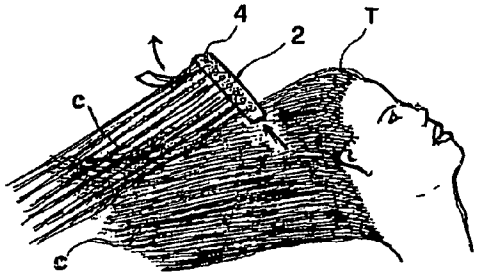
FIGS. 30 to 32 schematically illustrate, using perspective views, various phases of a method according to the present invention, carried out with said first embodiment of the assembly of FIG. 27.
Figure 31:
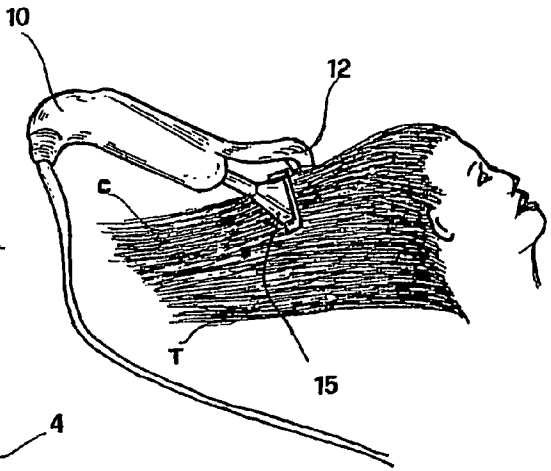
Figure 32:
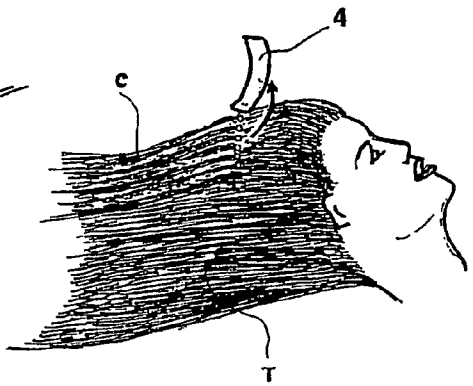
Figure 28:
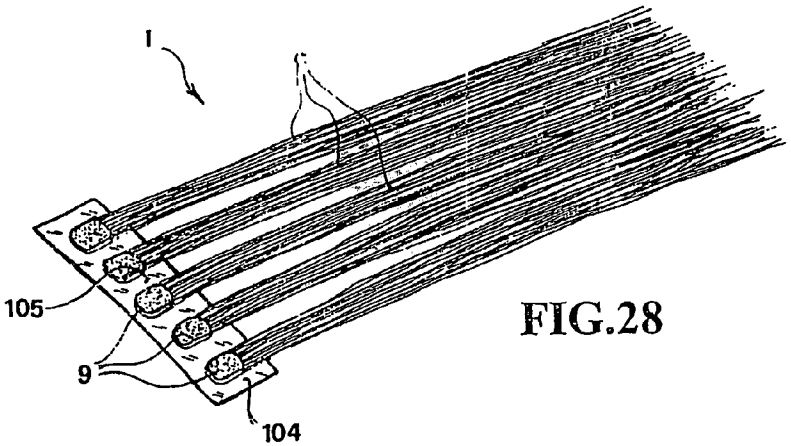
FIG. 28 shows a perspective view of a detail of the assembly of FIG. 27.

With reference to the thickening kit 1 described above, a method for thickening hair comprises the following application phases, described with reference to FIGS. 30 to 32.

According to said method and in accordance to what is described above, there is provided a plurality of extensions C having the respective proximal ends 7 provided with a respective connecting element 9 adhered, as specified, to the adhesive face of said second adhesive tape 104.

Instead, said first adhesive tape 102 is adhered to the hair to be thickened T, on an area designed to receive said proximal ends 7.

The first tape 102 applied to the outside of the hair, that is with the adhesive face facing the head and the non-adhesive face external. (FIG. 30). This operation can occur thus for simplicity's sake. However, it is proposed that the first tape 102 could be inserted in the hair T to adhere to said area from inside the hair, with the adhesive face of the first tape 102 facing the outside, that is oppositely with respect to the head.

Subsequently, the second tape 104 is mounted on the fixed element 12 of the applicator 10 or directly on the hair T as long as it is at said first tape 102. By virtue of the transparency of the tapes 102, 104 it will be possible, prior to the connection, to check the effect produced on the hair T to be thickened. The user can also check the effect by means of a mirror.

Subsequently, once the position of the tapes 102, 104 and therefore also of the extensions 6 as well as the adequateness of the selections in terms of length, shape, thickness and color has been decided on, the next step occurs in which the connecting elements 9 are connected to the hair of the user. In this phase, connection means essentially consisting of said tape 102 and of the connecting elements 9 are activated by the operator.

In the present embodiment, the melting property of the thermoplastic material is used. In fact, it is proposed that energy be applied to the connecting elements 9 via the adhesive tape 102. With reference to FIG. 4, the gripper applicator 10 is used in which the fixed element 12 and the movable element 15 have an elongated shape and can compress, applying a substantially uniform pressure, the tapes 102, 104 faced along its length, thereby compressing the connecting element 9.

It is proposed that this application, according to the same modes, could be repeated an infinite number of times always with identical results and without requiring the operator to exert any muscle force.

It is proposed that operation parameters like: exerted pressure, pressure duration, heating (temperature), heating duration, vibration frequency, vibration intensity, duration of vibrations, could be preset and stored in the control unit, and could be varied according to the specifications of the extensions and of the connecting elements to be applied.

Once this connection step is complete, it suffices, at the end of the cooling, to remove both tapes 102, 104 without leaving any glue on the hair (FIG. 32), to complete the operation.

Said second adhesive tape 104, supporting the proximal ends 7 of the hair extensions C, can be replaced by several modifications that will be described with reference to FIGS. 33 to 44.

Said first support tape, indicated in this modification by 204, has preferential tearing lines 208, formed in said support tape 202, such as to implement complementary portions of support tape 202, each comprising one or more proximal ends 7 of hair extensions C.

Specifically, in the present embodiment, a preferential tearing line 208 is comprised that can be implemented in several ways, in particular when the continuity of the support tape 204 is ensured by a support tape S not shown here. Among said ways, an engraved dotted line, a perforated line, a slit are mentioned.

In this example, the line 208 follows a substantially fret- or coil-shaped path so that the complementary portions of the tape 202 receive the proximal ends 7 and the respective connecting elements 9 of alternate hair extensions C.

By separating the two complementary portions a reduced assembly is obtained consisting of a semi element 209 extending longitudinally and having support areas 210 for connecting elements 9, joined by an edge band 211. It is proposed that a semi element 210 comprises an edge band 211 positioned through the extensions C and that the other semi element 210 comprise an edge band 11 opposite to the extensions C.

FIGS. 36 and 37 illustrate a mode of employ of the aforedescribed assembly 1. A first semi element 209*a*, supporting a number of extensions C characterized by a first color, is coupled to a complementary second semi element 209*b*, supporting an equal number of extensions C characterized by a second color.

The overlapping of the two semi elements leads to the formation of an assembly 1, as described with regard to said third embodiment, in which extensions C of different color are alternated. The flexibility of use entailed by this assembly of extensions is easily appreciated.

Said overlapping can occur by juxtaposing the edges of the two semi elements 209*a*, 209*b* or by overlapping an edge of said edges, to make use of the adhesion of the respective adhesive face 205 to recreate an assembly with a structurally united tape.

Figure 38:
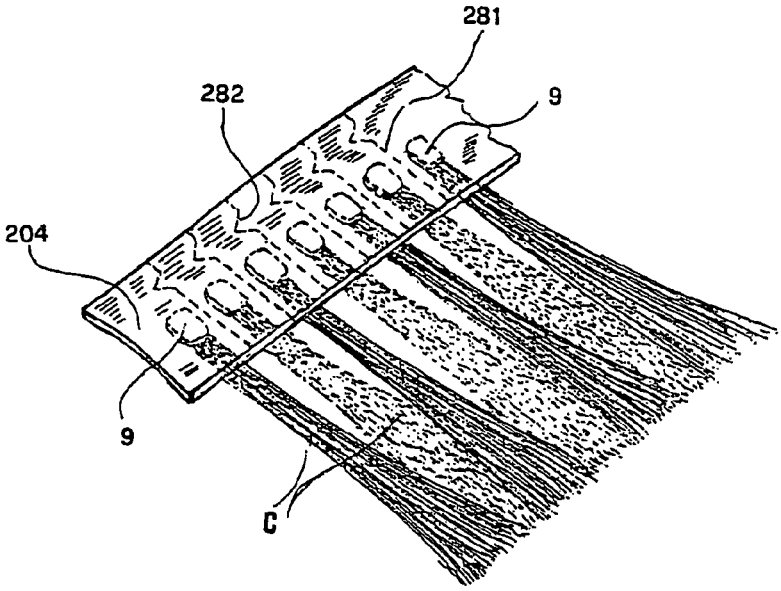
FIGS. 38 to 40 show, using perspective views, three further distinct modified implementations of the detail of FIG. 28.

In order to facilitate the separation of the extensions, the preferential tearing line 8 has a slit at the loops facing the extensions C and connecting sections at the loops facing oppositely to the extensions C. Thus, it is easier to separate the semi elements 209 in the portion facing the extensions, facilitating the disentangling of the latter. With reference to FIG. 38, another modification comprises a plurality of preferential tearing or mere separation lines 281 (totally equivalent in the presence of a support tape S) crossing edge-to-edge the second tape 204 separating each an individual connecting element 9. Each preferential tearing line 281 comprises a reference indent 282 to facilitate the assembling of the individual portions.

Figure 39:
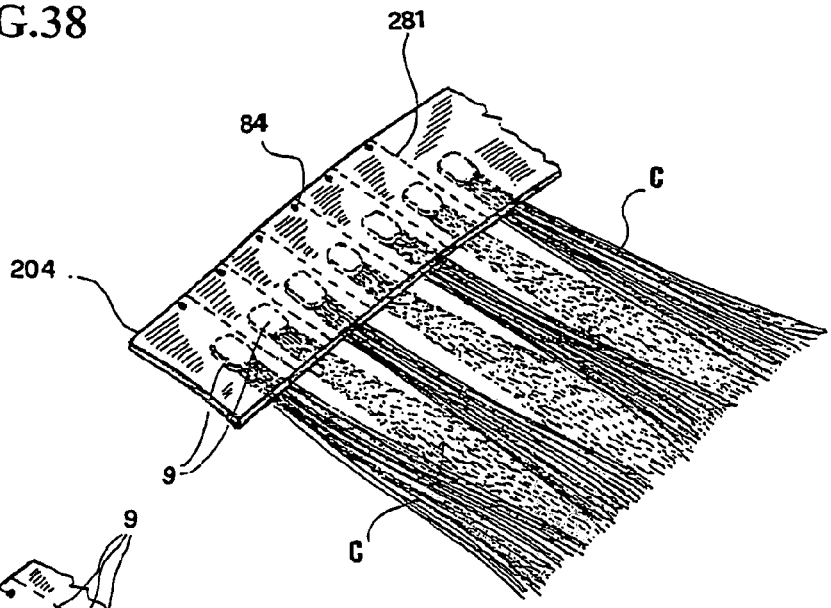

With reference to FIG. 39, a further modification proposes preferential tearing lines 281 in all analogous to those of the preceding modification. The tape 204 further comprises, for each portion, a visual position reference 284, that is a small dot of another mark printed on the tape 204. This reference replaces said reference indent 282 in its functions.

Figure 40:
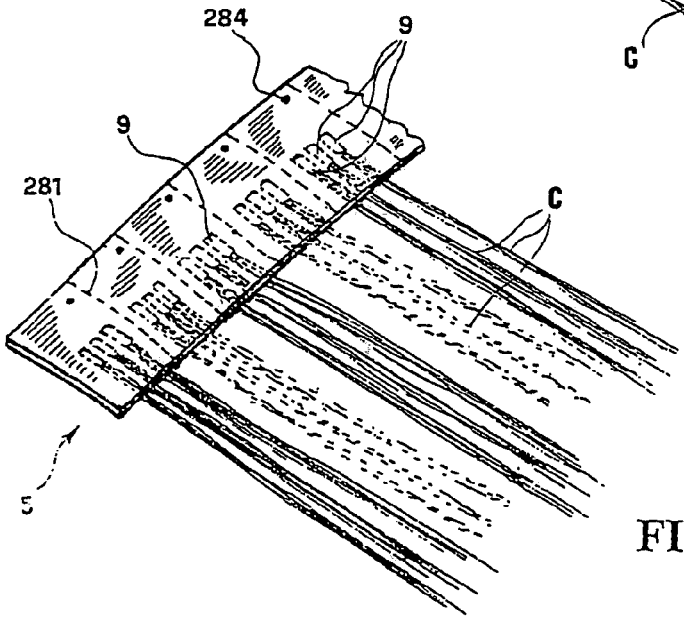
Figure 42:
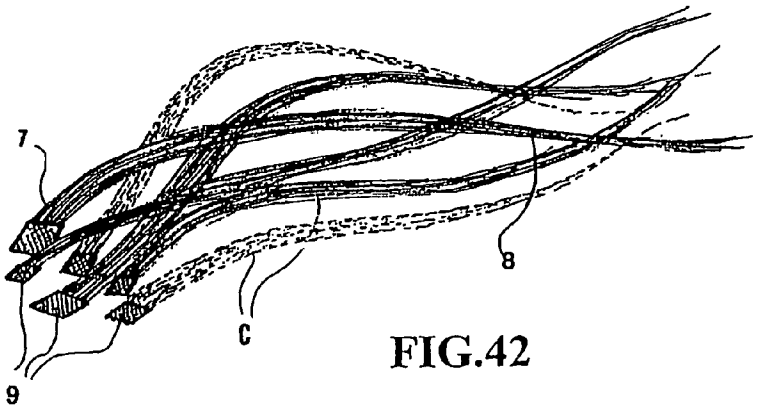
FIGS. 41 to 44 show, using perspective views, the assembling of another further modification of the detail of FIG. 28.
Figure 44:
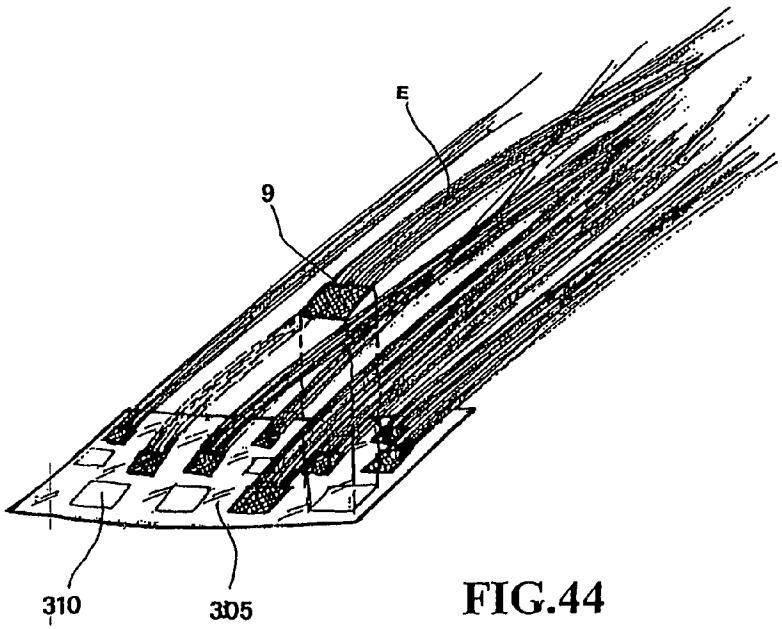
Figure 41:
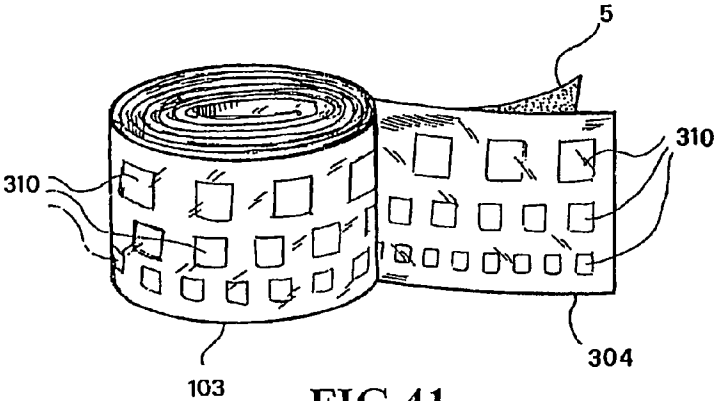
Figure 43:
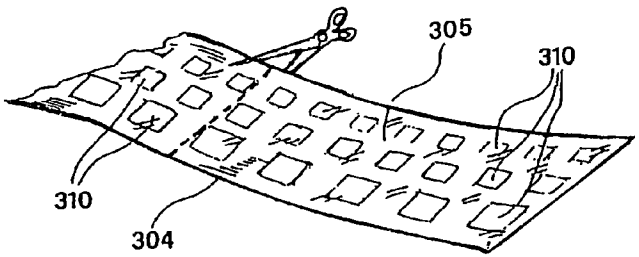

With reference to FIG. 40, a further modification proposes a discrete number of connecting elements 9, that is of extensions C, between each preferential tearing line 281, thereby enabling to mix the extensions C in sets.

According to a last modification, a section of the tape 304 functioning as the aforedescribed second adhesive tape 104 in the third embodiment of the assembly 1 can be prepared as follows (FIGS. 41 to 44).

A section of adhesive tape 304 is cut by an operator and the respective adhesive face 305 is exposed. Said adhesive face 305, as specified above, is apt to receive in adhesion said proximal ends 7, that is the respective connecting elements 9 of the hair extensions C.

For this purpose, said proximal ends 7 are adhered to said adhesive face 305 in accordance with the positioning means, which, in the present modification, consist of position indicators 310. In this example, on the adhesive tape 304 there are provided three rows of indicators, each having indicators of different shape. In particular, a first row comprises position indicators 310 for large-size connecting elements 9, a second row comprises position indicators 310 for medium-size connecting elements 9 and a third row comprises position indicators 310 for small-size connecting elements 9.

On each row, there is proposed a density of application of the extensions C that varies according to the size of the extension C, i.e., of the respective connecting element 9. In particular, by decreasing the size of the connecting element the pitch between position indicators 310 adjacent on the same row will be reduced.

However, it is understood that the resulting spacing is a proposal and the operator could anyhow use one of said rows to exactly align the extensions C on the adhesive tape 304. The position indicators 310 have a shape resembling that of the respective connecting elements 9, for example rectangle-rectangle, so that with the adhesion of the elements 9 to the respective indicator 310 the substantial parallelism of the extensions C placed on the same tape 304 is attained automatically.

However, it is understood that said position indicators are a non-limiting example for providing positioning means of proximal ends 7 with connecting element 9.

A further example may be represented by slits or recesses formed in the tape 304, of shape equal to that of the designed connecting element 9. Another example consists of a stencil with positioning traces that can be located below the tape 304. The traces are visible below the transparent tape, optionally with the aid of a back lighted plane. In all cases, it can be observed how these preliminary phases can be easily and rapidly carried out by an operator selecting extensions of desired shape, length, thickness and color, with the possibility to attain the most varied effects.

The aforedescribed method in all its modifications reduces the quantity of thermoplastic material used, energy used for activation, with no loss of heat and no contamination of the instrument or the connection device.

In addition, as can be appreciated, the method for increasing hair volume described above and the related assembly of extensions, due to the possibility of using numerous application variations, allows the professional operator to make maximum use of their imagination.

With particular reference to the use of the two tapes, the following advantageous operative results are attained:

a) Once separated, the hairs of the user are held in a fixed position by the tape and thus it is easier to manipulate the gripper applicator avoiding to cross hairs and extensions to each other.

b) The hairs of the user are protected from heat by being enclosed in said billfold shape.

c) The thermoplastic material is enclosed between two tapes or films and therefore cannot escape confinement, better entrapping the receiving hair without involving other hairs.

d) The surface of the fused and solidified connecting element is substantially not perceptible to the feel. The quality of this connection prevents water from penetrating between hairs of the connection, which is substantially sealed by the thermoplastic material.

e) The tape, which prevents outlets of thermoplastic material, prevents gripper contamination.

f) The tape can be held adhered until the end of the cooling of the thermoplastic material, without in the meantime preventing further connections, saving time.

g) The tape holds fixed the combing, which thus is more precise.

The aforedescribed method is not limited to a number of extensions adhered to the respective tape, number that can vary from one on.

To the aforedescribed method for increasing hair volume and related assembly one skilled in the art, in order to satisfy further and contingent needs, may effect several further modifications and variants, all comprised within the protective scope of the present invention, as defined by the appended claims.

The invention claimed is:

1. An assembly for increasing hair volume by thickening and/or lengthening, comprising:

one or a plurality of hair extensions having respective proximal ends provided with respective connecting elements; and an adhesive tape having a section with an adhesive face onto which said proximal ends are arranged according to a predetermined arrangement, said adhesive tape comprising a remainder apt to be folded on said section completely covering it, the section and the remainder being separated by a fold line, the adhesive face of said section being apt to be reversibly applied on receiving hair, the remainder having means for indicating the position of the connecting elements;

wherein the assembly further comprises a pair of recesses obtained either onto the tape at side edges thereof in a folded configuration or onto creasings connecting the remainder and a flap to the section, said recesses being positioned at said means for indicating the connecting elements to act as guide for a connection means.

2. The assembly according to one of the claims 1, wherein said connecting elements are made of a thermoplastic material.

3. The assembly according to claim 2, wherein the thermoplastic material comprises polyester and/or polyamide and/or polyurethanes.

4. The assembly according to claim 1, wherein said adhesive tapes are transparent.

5. The assembly according to claim 1, wherein the adhesive faces have an adhesive of a non-permanent and reversible type, operated by pressure, with an adhesive force on the respective tape greater than that produced on the thermoplastic material.

6. The assembly according to claim 1, wherein at least the adhesive tapes are resistant to heat.

7. The assembly according to claim 1, wherein the connecting elements are substantially equidistant and placed at the center of the respective section of adhesive tape, the extensions being aligned in parallel to each other, so that the hairs of adjacent extensions do not get knotted to each other.

8. The assembly according to claim 1, wherein the flap is opposite with respect to the remainder, is adhesive, and is apt to be connected to the remainder folded onto the section in substantially a billfold configuration.

9. The assembly according to claim 1, comprising a support tape, made of a material easily detachable from the adhesive tape, arranged to protect the adhesive faces and the connecting elements.

10. The assembly according to claim 1, wherein the adhesive face receiving the proximal ends of the hair extensions has position indicators.

11. The assembly according to claim 1, wherein the face of the adhesive tape designed to come into contact with said connecting element is substantially creased and/or has a marked surface roughness.

12. The assembly according to claim 11, wherein said faces have a surface roughness such as to make the adhesive tape and accordingly the applied connecting element opaque.

13. The assembly according to claim 12, wherein said roughness is obtained according to one of four modes: by a suitable glazing; by a mechanical corrosion, implementable for example with a sanding; by a chemical corrosion, implementable for example with an acid bath in which the tape is immersed; or by an abrasion, implementable with abrasive means rubbed on the tape face.

14. The assembly according to claim 11, wherein said faces have a plurality of ribs and grooves of transversal dimensions similar to the diameter of an individual hair and of orientation parallel to that of the hairs of the hair extensions.

15. The assembly according to claim 14, wherein said ribs and grooves are newly generated onto the tape face by one of four modes: by a suitable glazing, by an extrusion implemented with a suitable mold, by chemical etching, implementable for example with an adapt silk-screen pad and a corrosive agent applied through the pad; and by a mechanical removal of aligned strips of tape material with suitable abrasive means or surface etching means.

16. The assembly according to claim 1, wherein said faces have a surface roughness such as to make the adhesive tape, and accordingly the applied connecting element, opaque and have a plurality of ribs and grooves of transversal dimensions similar to the diameter of an individual hair and of orientation parallel to that of the hairs of the hair extensions.

17. The assembly according to claim 1, wherein the face of adhesive tape designed to come into contact with said connecting element is substantially covered with fluff.

18. The assembly according to claim 17, wherein said fluff is deposited by flocking.

19. The assembly according to claim 18, wherein said flocking is of electrostatic type.

20. The assembly according to claim 17, wherein said fluff is held on the tape by the respective adhesive faces.

21. The assembly according to claim 17, wherein said fluff is mixed to the adhesive of said adhesive faces.

22. The assembly according to claim 1, wherein the connecting elements are made of reactive hot-melt glue that is hardening in the presence of moisture.

23. The assembly according to claim 1, wherein the connecting elements are made of two-pack adhesive.

24. The assembly according to claim 1, wherein there are provided a plurality of hair extensions, positioned according to a predetermined arrangement, to allow their multiple application.

* * * * *